US007084393B2

(12) United States Patent
Fuhrer et al.

(10) Patent No.: US 7,084,393 B2
(45) Date of Patent: Aug. 1, 2006

(54) FAST TIME-OF-FLIGHT MASS SPECTROMETER WITH IMPROVED DATA ACQUISITION SYSTEM

(75) Inventors: Katrin Fuhrer, Gunten (CH); Marc Gonin, Gunten (CH); Thomas F. Egan, Houston, TX (US); William Burton, Houston, TX (US); J. Albert Schultz, Houston, TX (US); Valerie Vaughn, Pearland, TX (US); Steven Ulrich, Houston, TX (US)

(73) Assignee: Ionwerks, Inc., Houston, TX (US)

( * ) Notice: Subject to any disclaimer, the term of this patent is extended or adjusted under 35 U.S.C. 154(b) by 181 days.

(21) Appl. No.: 10/721,438

(22) Filed: Nov. 25, 2003

(65) Prior Publication Data

US 2005/0006577 A1 Jan. 13, 2005

Related U.S. Application Data

(60) Provisional application No. 60/429,652, filed on Nov. 27, 2002.

(51) Int. Cl.
*H01J 49/40* (2006.01)

(52) U.S. Cl. ..... 250/283; 250/287

(58) Field of Classification Search ..... 250/283, 250/287, 281, 282, 397
See application file for complete search history.

(56) References Cited

U.S. PATENT DOCUMENTS

| | | | | |
|---|---|---|---|---|
| 5,367,162 | A | 11/1994 | Holland et al. | |
| 5,777,325 | A | 7/1998 | Weinberger et al. | |
| 6,373,052 | B1 | 4/2002 | Hoyes et al. | |
| 6,747,271 | B1 * | 6/2004 | Gonin et al. | 250/281 |
| 6,800,847 | B1 | 10/2004 | Axelsson | |
| 6,909,090 | B1 * | 6/2005 | Gonin et al. | 250/282 |
| 2002/0175292 | A1 | 11/2002 | Whitehouse et al. | |

* cited by examiner

*Primary Examiner*—Kiet T. Nguyen
(74) *Attorney, Agent, or Firm*—Fulbright & Jaworski L.L.P.

(57) ABSTRACT

Time-of-flight mass spectrometer instruments are disclosed for monitoring fast processes with large dynamic range using a multi-threshold TDC data acquisition method or a threshold ADC data acquisition method. Embodiments using a combination of both methods are also disclosed.

5 Claims, 22 Drawing Sheets

40
50
PC
70
histogram array
5 particles
45 small anodes
51
4 ch. preamp
57
58
channel data weighting
channel data weighting
data combination
24 channel discriminator
24 channel TDC
preamp
signal splitter
55
electron multiplier 41
large anode 44

| | dynamic ratio | accuracy 100% | 50% | 30% | 20% | 10% | 5% |
|---|---|---|---|---|---|---|---|
| threshold levels | 4 | 27 | 8.00 | 4.10 | 2.74 | 1.73 | 1.33 |
| | 8 | 2,187 | 128.00 | 26.84 | 10.54 | 3.58 | 1.95 |
| | 16 | 14,348,907 | 32,768.00 | 1,152.92 | 155.57 | 15.41 | 4.18 |
| | 20 | 1.16E+09 | 524,288.00 | 7,555.79 | 597.63 | 31.95 | 6.12 |
| | 24 | 9.41E+10 | 8,388,608.00 | 49,517.60 | 2,295.86 | 66.25 | 8.95 |
| | 32 | 6.18E+14 | 2.15E+09 | 2.13E+06 | 3.39E+04 | 284.85 | 19.19 |
| | 40 | 4.05E+18 | 5.50E+11 | 9.13E+07 | 5.00E+05 | 1,224.81 | 41.14 |
| | 48 | 2.66E+22 | 1.41E+14 | 3.92E+09 | 7.38E+06 | 5,266.46 | 88.20 |

Figure 8

FAST TIME-OF-FLIGHT MASS SPECTROMETER WITH IMPROVED DATA ACQUISITION SYSTEM

RELATED APPLICATIONS

This application claims priority to U.S. Provisional Application 60/429,652 filed on Nov. 27, 2002.

FIELD OF THE INVENTION

A time-of-flight mass spectrometer ("TOF") with a new data acquisition system is disclosed that combines the advantages of current data acquisition systems such as Analog-to-Digital ("ADC") type systems and Time-to-Digital ("TDC") type systems and that is capable of monitoring fast processes with a large dynamic range.

BACKGROUND OF THE INVENTION

A TOF is an instrument for qualitative and/or quantitative chemical and biological analysis. There is an increasing need for mass analysis of fast processes, which, in part, arises from the popularity of fast multi-dimensional separation techniques such as Gas Chromatography TOF ("GC-TOF"), Mobility-TOF, Electron Monochromator TOF ("EM-TOF"), and other similar techniques. In these methods, the TOF serves as a mass monitor scanning the elution of the analyte of the prior separation methods.

There are numerous other fields of application involving the investigation of fast kinetic processes. Two examples are the chemical processes during gas discharges, and photon or radio frequency induced chemical and plasma ion etching. In the case of gas discharges, one may monitor the time evolution of products before, during, and after the abrupt interruption of a continuous gas discharge or during and after the pulsed initiation of the discharge. An analogous monitoring of the chemical processes in a plasma etching chamber may be performed. The time profile of chemical products released from a surface into a plasma can be determined either during and after the irradiation with laser pulses or before, during, and after the application of a voltage that induces etching (e.g., RF plasma processing). A third such example is the time evolution of ions either directly desorbed from a surface by energetic beams of X-ray, laser photons, electrons, or ions. In addition, when the ions are desorbed from a surface, there is usually a more predominant co-desorption of non-ionized neutral elements and molecules whose time evolution can be monitored by first post-ionizing neutral species that have been desorbed and then measuring mass separated time evolution of the ions by mass spectrometry. Yet a fourth area of use is the monitoring of the time evolution of neutral elements or molecules reflected after a molecular beam is impinged on a surface. The importance of such studies ranges from fundamental studies of molecular dynamics at surfaces to the practical application of molecular beam epitaxy to grow single crystalline semiconductor devices. A further application for fast analysis is the online analysis of aerosol particles, where the aerosol particles are sorted according to their size in time, and where the aerosols must be analyzed.

In all such studies, the time evolution of ion signals that have been mass resolved in a mass spectrometer is crucial. TOF instruments have become the instrument of choice for broad range mass analysis of fast processes.

TOF instruments typically operate in a semi-continuous repetitive mode. In each cycle of a typical instrument, ions are first generated and extracted from an ion source (which can be either continuous or pulsed) and then focused into a parallel beam of ions. This parallel beam is then injected into an extractor section comprising a parallel plate and grid. The ions are allowed to drift into this extractor section for some length of time, typically 5 μs. The ions in the extractor section are then extracted by a high voltage pulse into a drift section followed by reflection by an ion mirror, after which the ions spend additional time in the drift region on their flight to a detector. The time-of-flight of the ions from extraction to detection is recorded and used to identify their mass. Typical times-of-flight of the largest ions of interest are in the range of 10 μs to 200 μs. Hence, the extraction frequencies are usually in the range of 5 kHz to 100 kHz. If an extraction frequency of 50 kHz is used, the TOF is acquiring a full mass spectrum every 20 μs. The extraction frequency is often the fastest time scale for process monitoring. For example, monitoring a process with a TOF operating at 50 kHz extraction frequency allows for process monitoring at 20 μs time resolution. However, with special techniques disclosed in PCT application PCT/US02/16341 (Gonin et al., "A Time-Of-Flight Mass Spectrometer for Monitoring of Fast Processes"), it is possible to reduce the time resolution to one tenth or better of the extraction frequency.

Each of these fast process monitoring TOFs uses a data acquisition system based on a time-to-digital converter (TDC). Acquisition systems based on analog-to-digital converters (ADC) produce more data than can be processed by the data storage and evaluation computer. For example, a 2 GHz 8 bit ADC produces 2000 MBytes/s, which is beyond what a PCI card can transfer to a PC bus. Therefore ADC systems are used in only two cases: (1) for very short processes that must be monitored, such as for example in MALDI TOF where a LASER produces ions for a single TOF extraction, or (2) for rather slow processes that have to be monitored, where several TOF extractions could be accumulated in a fast memory internal to the ADC acquisition system, and where this memory is then periodically transferred to the PC.

In the cases where many consecutive TOF extractions have to be recorded individually (with no accumulation), the TDC technique is used. TDCs, however, have a limited dynamic range, producing one measurement per mass peak for each extraction, making it difficult to record single TOF extractions with mass peaks covering a large dynamic range (e.g., very faint mass peaks with less than one ion per extraction, and, in the same extraction, abundant mass peaks with many hundreds of ions per extraction are present).

Thus, TOFs with more effective data acquisition methods and corresponding apparatuses for monitoring fast ion processes that allow for continuous extraction monitoring with high dynamic range are needed.

SUMMARY OF THE INVENTION

One embodiment of the present invention consists of a TOF comprising an ADC based data acquisition system, wherein only data exceeding a pre-selected threshold value is transferred to the data acquisition system. This allows skipping spectral regions where no ions are present, thus considerably reducing the amount of data to be transferred, and allowing for continuous single extraction acquisition even with ADC systems.

Another embodiment of the present invention consists of a TOF comprising a TDC based data acquisition system with multiple TDC channels. The channels are triggered at increasing signal amplitudes, thus making it possible to record the amplitude of TOF mass peaks.

In a further embodiment, a multi-threshold TDC system includes some additional anodes in order to acquire mass peaks of low ion multiplicity (e.g., a few ions per mass peak).

One embodiment is a time-of-flight mass spectrometer comprising an ion source that generates ions, an ion extractor, fluidly coupled to the ion source, that extracts the ions from the ion source, an ion detector, fluidly coupled to the ion source, that detects the ions, a timing controller, in electronic communication with the ion source and the ion extractor, that controls the time of activation of the ion source and that activates the ion extractor according to a predetermined sequence, a data acquisition system that comprises an ADC and that acquires data from the ion detector, and a data processing system that receives from the data acquisition system transient regions from the ADC exceeding a predefined single ion threshold level.

Another embodiment is a time-of-flight mass spectrometer, comprising an ion source that generates ions, an ion extractor, fluidly coupled to the ion source, that extracts the ions from the ion source, an ion detector, fluidly coupled to the ion source, that detects the ions, a timing controller, in electronic communication with the ion source and the ion extractor, that controls the time of activation of the ion source and that activates the ion extractor according to a predetermined sequence, a data acquisition system that comprises a multi-channel TDC and that acquires data from the ion detector such that an ion peak triggers a combination of TDC channels that is characteristic for the height of the ion peak, and a data processing system that receives the data from the data acquisition system and estimates the peak height from the data.

In some embodiments, the ion detector in these time-of-flight mass spectrometers comprises a multi-anode detector. In other embodiments, the ion detector in these time-of-flight mass spectrometers comprises a first multi-channel plate, a second multi-channel plate behind the first multi-channel plate wherein the second multi-channel plate is operated in a linear mode, and a CuBe mesh behind the second multi-channel plate. In one embodiment, the front surface of the first multi-channel plate is covered with a thin semiconductor film that is doped and reverse biased so as to increase the production of electrons and/or secondary hydrogen ions in response to an energetic particle, which may be an ion, hitting the film. In one embodiment, the film is a nitride film doped with alkali. In another, the film is GaN doped with lithium. In yet another, the film further comprises graded strained superlattice layers of GaN and GaAlN.

In a further embodiment, the time-of-flight mass spectrometer further comprises a converter plate covered with a thin semiconducting film. In one embodiment, the film is a nitride film doped with alkali. In another, the film is GaN doped with lithium. In yet another, the film further comprises graded layers of GaN and GaAlN.

Another embodiment further comprises a third multi-channel plate operated in linear mode and situated between the second multi-channel plate and the CuBe mesh. In some embodiments, the ion detector comprises Wilkinson ADC fast rundown circuitry.

In yet another embodiment, the ion detector comprises a flat semiconductor wafer on which is deposited a thin doped nitride layer or alternating strained thin nitride superlattice structure that is reverse biased. This structure can be biased to high voltage to accelerate ions (including large bio-ions) into the surface, which then acts as a converter surface by liberating secondary electrons or secondary hydrogen ions as a result of the ion collision. The liberated secondary particles are separated by a magnetic field and the electrons are transported to one detector and the secondary hydrogen ions are transported through a time focusing mass spectrometer to a second detector. The time and spatial focus of the electrons and the secondary Hydrogen ions can be maintained by proper choice of the transport ion optical elements.

One embodiment is a method of processing transient data from fast processes using a time-of-flight mass spectrometer, comprising the step of generating ions in an ion source, the step of extracting the ions according to a predetermined sequence to produce extracted ions, the step of separating the extracted ions, the step of detecting the extracted ions with an ion detector to produce a transient, the step of acquiring the transient with a data acquisition system, and the step of transferring to a data processing unit only those regions of the transient that exceed a predefined threshold.

Another embodiment further comprises the step of transferring position flags on the regions to the data processing unit, the step of analyzing abundances of the ions from the regions and corresponding position flags, and the step of analyzing the temporal profile of the fast processes with the time of activation of the extracting step.

Another embodiment is a method of processing transient data from fast processes using a time-of-flight mass spectrometer, comprising the step of generating ions in an ion source, the step of extracting the ions according to a predetermined sequence to produce extracted ions, the step of separating the extracted ions, the step of detecting the extracted ions with an ion detector to produce a transient, the step of splitting the transient into a plurality of channels, the step of triggering TDC measurements in each channel of the plurality of channels wherein the triggering occurs at a different signal height for each channel of the plurality of channels, the step of transferring timing signals from the triggering step to a data processing unit, and the step of estimating a signal height and pulse shape by determining which channels were triggered in the triggering step.

Another embodiment further comprises the step of analyzing abundances of the ions from the estimated signal height and the step of analyzing a temporal profile of the fast processes with the time of activation of the extracting step.

One embodiment further comprises the step of applying a different amplification to each channel of the plurality of channels. Another embodiment further comprises the step of applying a different attenuation to each channel of the plurality of channels. An additional embodiment further comprises the step of applying a different discriminator level to each channel of the plurality of channels. In yet another embodiment, the detecting step further comprises detecting the ions with a multi-anode ion detector to resolve non-linearities in high ion multiplicity peaks.

One embodiment is a method for determining the number of ions impinging an ion detector in a time-of-flight mass spectrometer, comprising the step of providing a multi-channel plate that produces an electron cloud in response to receiving an impinging ion, the step of defocusing the electron cloud onto a pixelated anode array, the step of measuring the fractions of the electron cloud received by nearest neighbor electrodes in the anode array, and the step of determining the number of ions impinging the ion detector, the time of arrival of each ion, and the spatial location at which the ion collided with detector by centroiding the electron charge fraction appearing simultaneously on nearest neighbor anodes.

In one embodiment, the pixelated array is an array of 64 anodes. In another embodiment, the pixelated array is an array of 256 anodes. An additional embodiment further comprises the step of providing a meander delay line in front of the pixelated array.

One embodiment is a time-of-flight mass spectrometer comprising an ion source that generates ions, an ion extractor, fluidly coupled to the ion source, that extracts the ions from the ion source, an ion detector, fluidly coupled to the ion source, that detects the ions, a timing controller, in electronic communication with the ion source and the ion extractor, that controls the time of activation of the ion source and that activates the ion extractor according to a predetermined sequence, and a data acquisition system that comprises an ADC and a TDC and that acquires data from the ion detector wherein the TDC detects an ion peak having a transient from the ion detector and causes the ADC to record the transient.

Another embodiment is a time-of-flight mass spectrometer comprising an ion source that generates ions, an ion extractor, fluidly coupled to the ion source, that extracts the ions from the ion source, an ion detector, fluidly coupled to the ion source, that detects the ions, a timing controller, in electronic communication with the ion source and the ion extractor, that controls the time of activation of the ion source and that activates the ion extractor according to a predetermined sequence, and a data acquisition system that comprises an ADC and a TDC and that acquires data from the ion detector wherein the TDC and the ADC operate in parallel with the ADC resolving high ion multiplicities from the ion detector and the TDC increasing the dynamic range of the ion detector by sensitively detecting single ion events.

A further embodiment is a method for detecting the time of arrival of an ion signal in a time-of-flight mass spectrometer comprising the step of serializing a known parallel data word into a serial data stream, the step of modulating the serial data stream with the ion signal, thereby creating a modulated serial data stream, and the step of deserializing the modulated serial data stream to determine the time of arrival.

BRIEF DESCRIPTION OF THE DRAWINGS

The following figures form part of the present specification and are included to further demonstrate certain aspects of the present invention. The invention may be better understood by reference to one or more of these drawings in combination with the detailed description of specific embodiments presented herein.

FIG. 8 is a table indicating the maximum dynamic peak ratio as a function of the number of TDC channels and the requested peak height accuracy.

DETAILED DESCRIPTION OF THE INVENTION

As used herein in the specification, "a" or "an" may mean one or more, and "another" may mean at least a second or more. The term "coupled" may involve either a direct coupling or an indirect coupling with intervening components. Unless indicated otherwise, the terms "behind" and "in front" refer to the path of through the mass spectrometer, with a component nearer the ion source being "in front" of a component closer to the ion detector, and a component nearer the ion detector being "behind" a component closer to the ion source.

The following discussion contains illustrations and examples of preferred embodiments for practicing the present invention. However, they are not limiting examples. One of skill in the art would recognize that other examples and methods are possible in practicing the present invention.

As used herein, "time resolving power" is defined as the time of ion release by a process and the accuracy with which this release time can be determined. This concept is expressed mathematically as T/ΔT where T is the time of ion release in the process and ΔT is the accuracy of the measurement of T. "Time resolving power" is used synonymously with "temporal resolving power."

As used herein, "TOF" is defined as a time-of-flight mass spectrometer. A TOF is a type of mass spectrometer in which ions are all accelerated to the same kinetic energy into a field-free region wherein the ions acquire a velocity characteristic of their mass-to-charge ratios. Ions of differing velocities separate and are detected at different times.

As used herein, "ADC" refers to analog to digital converter, and "TDC" refers to time to digital converter. The term "rundown" or "Wilkinson voltage amplitude to time analog rundown converter" refers to a circuit that measures the detector pulse height amplitude when an ion is detected. An "electron pulse height distribution" or "detector output pulse height distribution" refers to the secondary electron output onto the anode in response to one or more ions simultaneously hitting the detector above this anode.

Figure 1:
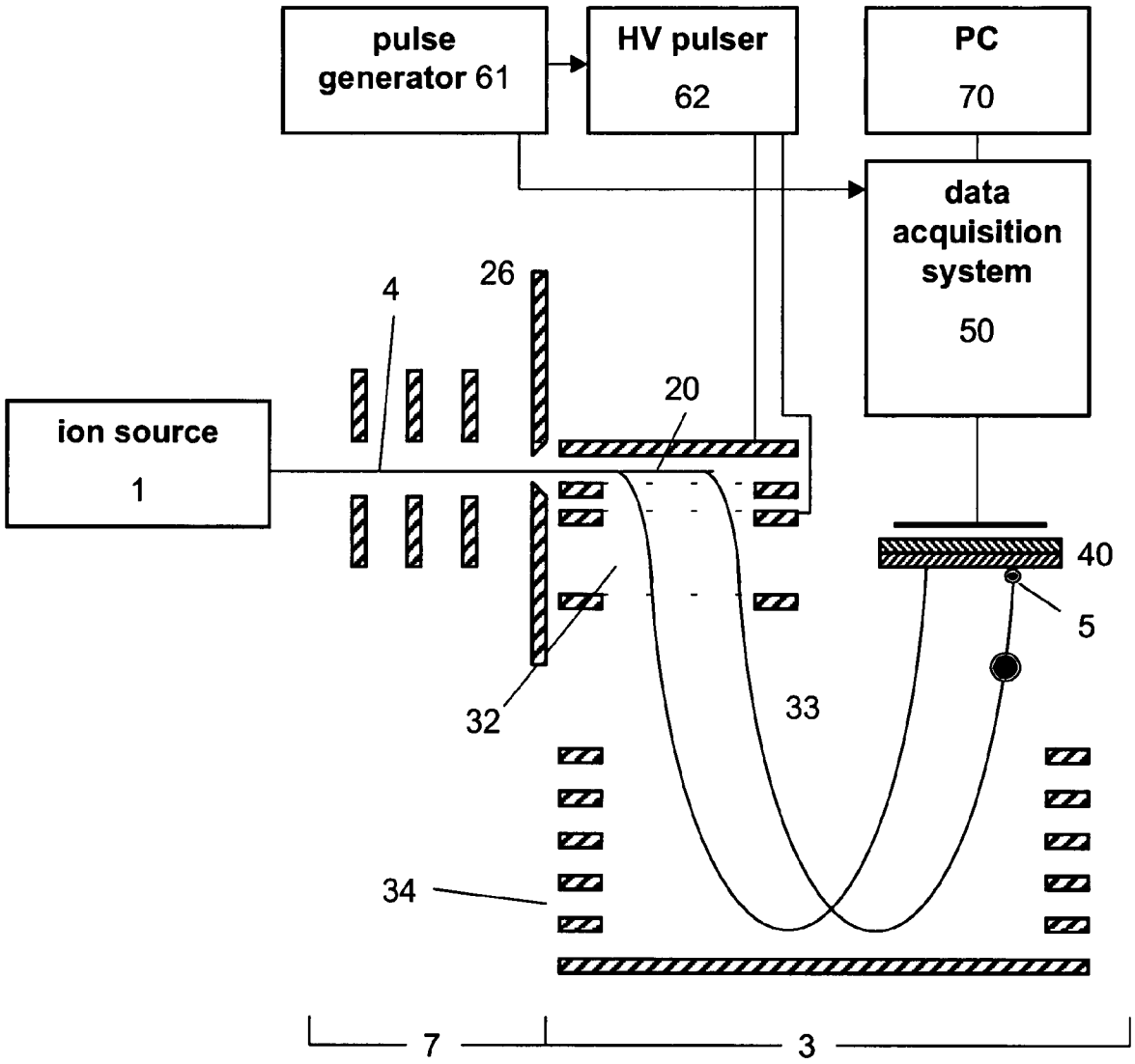
FIG. 1 illustrates a TOF comprising the basic architecture of the present invention. The data acquisition systems disclosed in this document may be used with this instrumental platform.

Referring to FIG. 1, all TOFs have ion source 1. In some cases, the temporal development of the ion generation itself is analyzed. For example, the kinetics of the formation of a chemical ion species during a discharge may be investigated. In other cases, a chemical or physical process that does not generate ions but only neutral particles may be under investigation. In this case, these neutral particles must be ionized for the analysis, for example, by a high flux continuous or pulsed high energy photon source. The analysis of neutral species in a chemical reaction and the desorption of neutral atoms and molecules from a surface are examples of such an application. In still another case, the temporal release of existing ions may be of interest. This is, for example, the case in an ion mobility spectrometer wherein the temporal elution of ions at the end of the mobility spectrometer is monitored in order to get information about the mobility of these ions. In still another case, the temporal release of analyte may be of interest. This is, for example, the case in an aerosol particle analyzer wherein the temporal elution of particles at the end of the particle spectrometer is monitored in order to get information about the size of the particles. Any and all instruments and methods for creating or releasing ions are collectively referred to as "ion sources" herein.

As shown in FIG. 1, most time-of-flight mass spectrometers operate in a cyclic extraction mode and include primary beam optics 7 and time-of-flight section 3. In each cycle, ion source 1 produces a stream of ions 4, and a certain number of particles 5 (up to several thousand in each extraction cycle) travel through extraction entrance slit 26 and are extracted in extraction chamber 20 using pulse generator 61 and high voltage pulser 62. The particles then traverse flight section 33 (containing ion accelerator 32 and ion reflector 34) towards ion detector 40.

Continuing to refer to FIG. 1, ion detector 40 is used to create the stop signal of the time-of-flight measurement. The most common detectors used in TOF are electron multiplier detectors, where the ion to be detected generates one or several electrons by collision with an active surface. An acceleration and secondary electron production process then multiplies each electron. This electron multiplication cycle is repeated several times until the resulting electron current is large enough to be detected by conventional electronics. Other more exotic detectors detect the ion energy deposited in a surface when the ion impinges on the detector. Other detectors make use of the signal electrically induced by the ion in an electrode. Any and all of these apparatuses and corresponding methods of ion detection, which are discussed in detail in the literature and known to those of ordinary skill in the art, are collectively referred to as "ion detectors."

The electrical signal produced by ion detector 40 is further processed by data acquisition system 50. Data acquisition system 50 converts the analog electrical signal into digital data so that this data may be processed by data processing unit 70, which is typically a PC.

Currently there are two primary classes of data acquisition systems: time-to-digital converter (TDC) type systems and analog-to-digital converter (ADC) type systems.

A typical TDC generates only "yes" or "no" information from each ion signal generated by ion detector 40. That means that the TDC acquisition does not retain any information about the signal amplitude or the number of ions that generated a particular signal. This is a serious drawback of TDC data acquisition because it limits the dynamic range of data acquisition.

Several methods have been proposed to increase the dynamic range of TDC data acquisition. Barbacci et al. (D. C. Barbacci, D. H. Russel, J. A. Schultz, J. Holoceck, S. Ulrich, W. Burton, and M. Van Stipdonk, Multi-anode Detection in Electrospray Ionization Time-of-Flight Mass Spectrometry, J. Am. Soc. Mass Spectrom. 9 (1998) 1328–1333) describe a multi-anode detector with four anodes and four separate TDC channels, thus increasing the dynamic range by a factor of up to four. This method has the drawback that it requires huge numbers of TDC channels in order to increase the dynamic range significantly. For example, more than 100 anodes and 100 TDC channels would be required in order to achieve the dynamic range of an 8 bit ADC. In order to reduce the number of TDC channels, and hence the cost, unequal anode detectors have been disclosed by Bateman et al. (WO 99/38191A2), Gonin (WO 99/67801A2), and Makarov et al. (WO 01/18846A2). Such a system allows for increasing the dynamic range by a factor of 40 to 100 with only a few TDC channels that are readily available in today's TDC hardware. However, this system relies on data accumulation, i.e., accumulating similar extractions in memory, and hence is not well suited for increasing dynamic range with single TOF extraction measurements. MALDI-TOF is an example in which the unequal anode method fails to deliver acceptable results.

An alternate method to acquire TOF data is the use of a fast ADC or transient recorder. The disadvantage of this method is that a large amount of data is produced for each TOF extraction. If, for a measurement, it is possible to accumulate data from several extractions into an accumulation histogram memory, then the data rate is greatly reduced. For continuous single TOF extraction acquisition, which is necessary for monitoring fast processes, the data rate is overwhelming. For example, with a 2 Gs/s 8 bit ADC, the data rate is up to 2000 MBytes/s, which is far beyond the data rate acceptable for ordinary data processing arrangements.

In order to overcome these disadvantages of TOFs using current ADC systems or TDC systems, TOFs with improved data acquisition systems are disclosed herein. In particular, two different and independent instruments and methods (as well as their combination) for obtaining continuous single extraction recording with high dynamic range by TOF analysis are disclosed. The first method includes a TDC acquisition scheme, and the second method uses an ADC acquisition scheme. Both of these methods allow one to obtain temporal information of a fast process at an increased dynamic range.

1) TDC Method (Time-to-Digital Converter)

Figure 2:
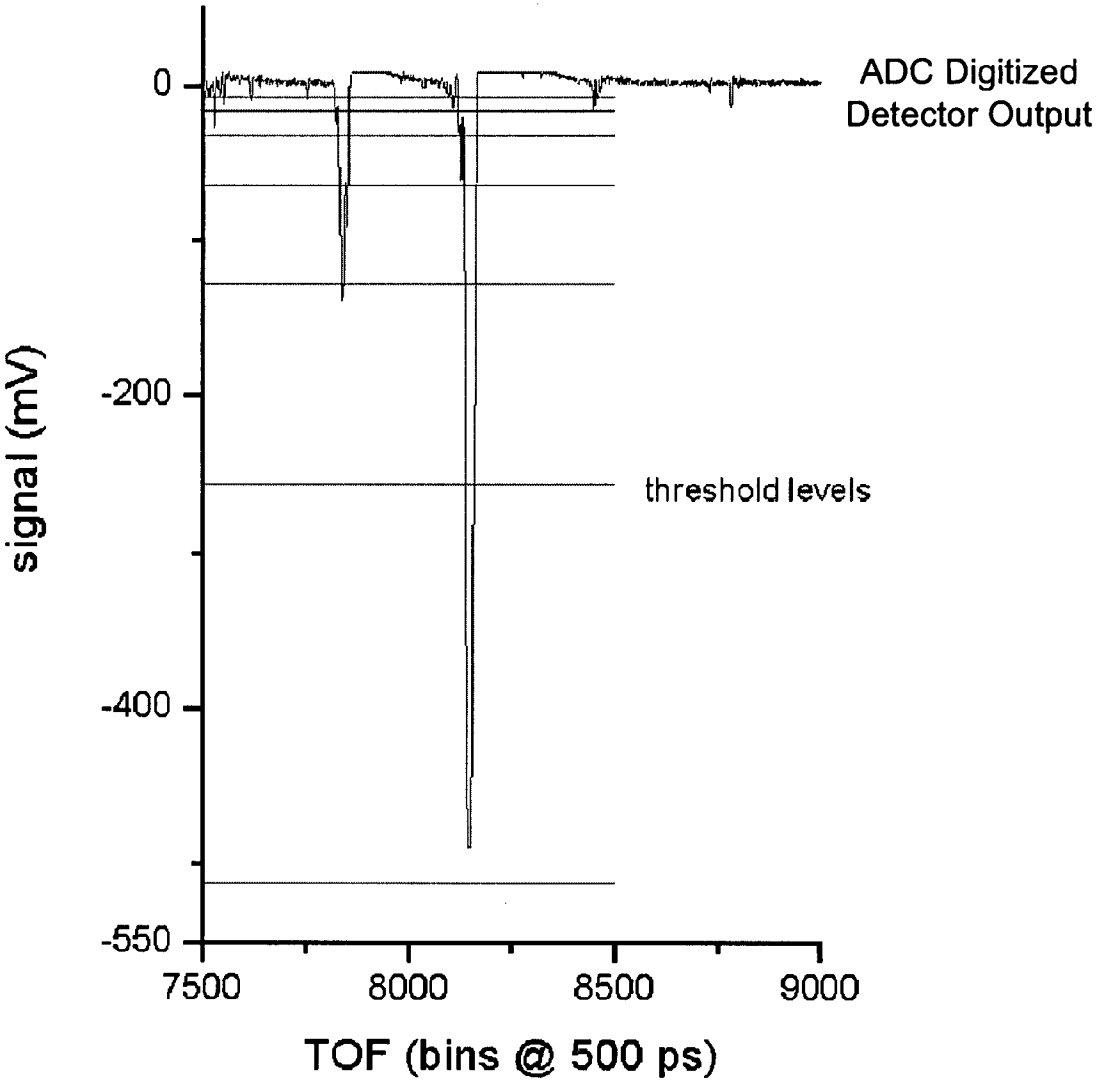
FIG. 2 illustrates an embodiment of the multi-threshold TDC acquisition method. A mass peak triggers those TDC channels whose threshold levels are exceeded by the signal peak.
Figure 3:
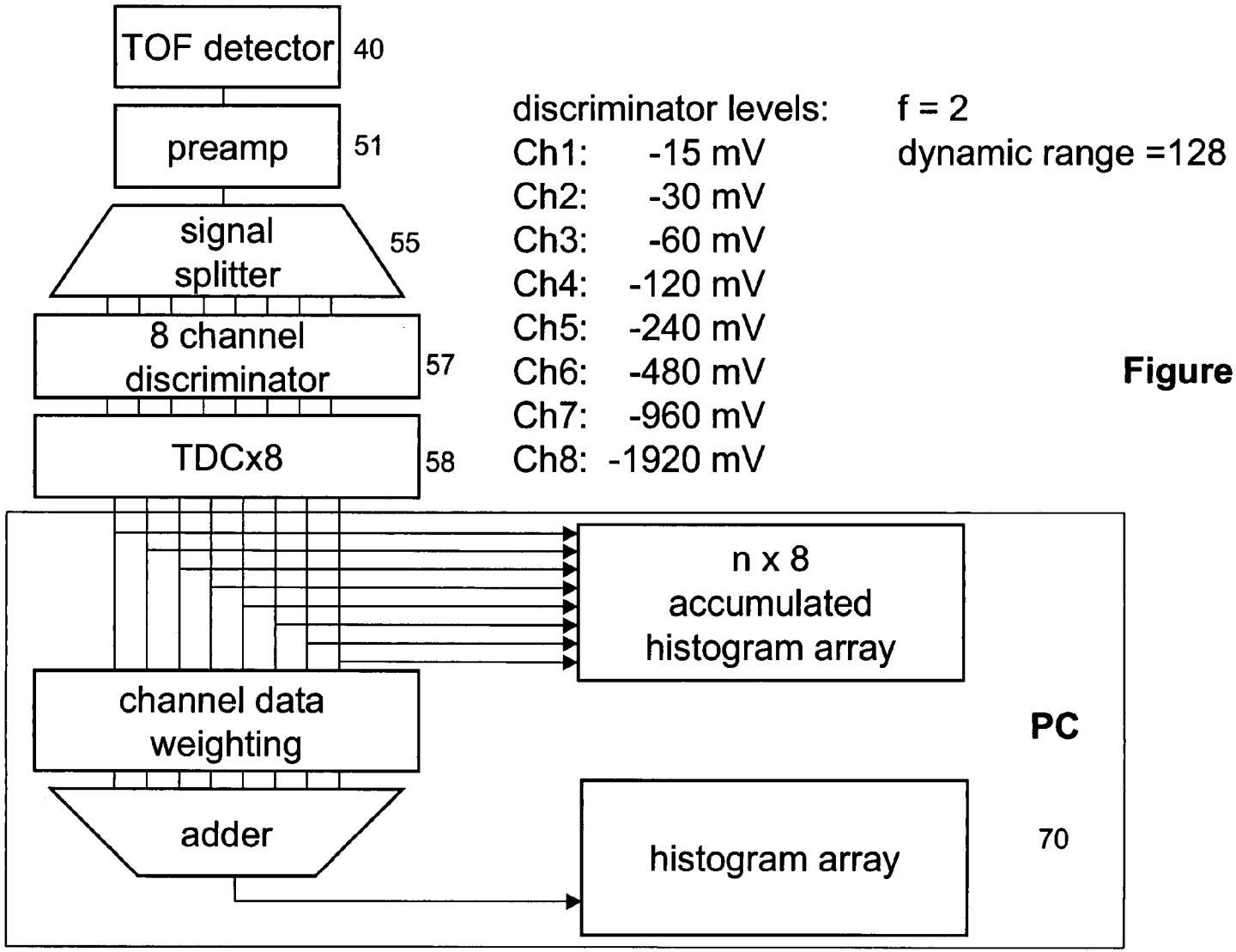
FIG. 3 is a more detailed illustration of an electronic scheme of the multi-threshold TDC acquisition.

The TDC acquisition scheme with increased dynamic range is illustrated in FIG. 2 and FIG. 3 and may be used with the instrumental platform shown in FIG. 1. According to the multi-threshold configuration of the present invention, each ion peaks triggers, according to its peak height, one or several TDC channels. Thus, it is possible to deduce the peak height from a knowledge of which channels are triggered.

In general, the thresholds are preferably spaced in a logarithmic scale. For example, the thresholds illustrated in FIG. 2 are spaced with a factor 2, e.g., −8 mV, −16 mV, −32 mV, etc. This spacing allows measuring the signal height within the range of thresholds with the same relative accuracy.

The lowest threshold is set to exceed the noise level, but not to exceed the single ion peak height. This ensures that all ions are recorded, whereas spectrum regions with only noise are excluded.

Preferably, only the most significant threshold triggered by any ion peak is transferred to the data processing unit. For example, the large peak in FIG. 2 crosses six threshold levels. Only the threshold at the −256 mV channel needs to be transferred to the computer because all less significant threshold channels contain redundant information. This so-called redundant-threshold-discrimination allows decreasing the data transfer rate even further. It can be accomplished with window discriminators, digital signal processors, or other data processing methods in the TDC acquisition electronics.

Since most spectra contain only a few high multiplicity multi-ion peaks (mass peaks with more than one ion per TOF extraction), and in addition also contain only a few single ions, the data rate to be transferred to the computer is reduced.

Further, it is also possible to transfer all threshold channels. In this case, it is possible to interpolate more accurate timing from the different threshold information. For example, since the peaks have shoulders, the least significant threshold level will be triggered first, and the most significant level will be triggered last. This allows reproducing the rising edge of a peak and hence allows for accurate determination of the position of the rising edge half height. In principle, this allows numerically interpolating mass peak arrival times with higher timing accuracy than the TDC least-significant bit value.

If more TDC channels with different threshold levels are available, then a more accurate determination of the peak height is possible. FIG. 8 shows a table in which peak height accuracy is displayed as a function of the number of TDC channels and the dynamic range to be covered with those channels. For example, a TDC with 24 different threshold levels and a required measurement accuracy of 20% allows for a dynamic ratio of approximately 2295, which means that the ratio of the largest peak and the smallest peak can be up to 2295.

To deduce the number of ions from the peak height, it may be necessary to correct for changing peak width in the TOF spectra. High mass peaks are wider and therefore, at the same height, contain more ions than low mass peaks.

FIG. 3 illustrates the typical electronic components used for a multi-threshold TDC acquisition system. The signal coming from TOF detector 40 is amplified in preamplifier 51 and then split into the different channels by signal splitter 55. Channel signals are then routed through multi-channel discriminator 57, where the signals are discriminated with different threshold levels. Those channels where the signal exceeds the threshold level will output a standard signal, which is provided to multi-channel TDC 58. The TDC measures the arrival time of those signals and transfers the measurements as digital data to computer 70. The digital measurements are processed according to the specific requirements of the analysis to be performed.

Figure 4:
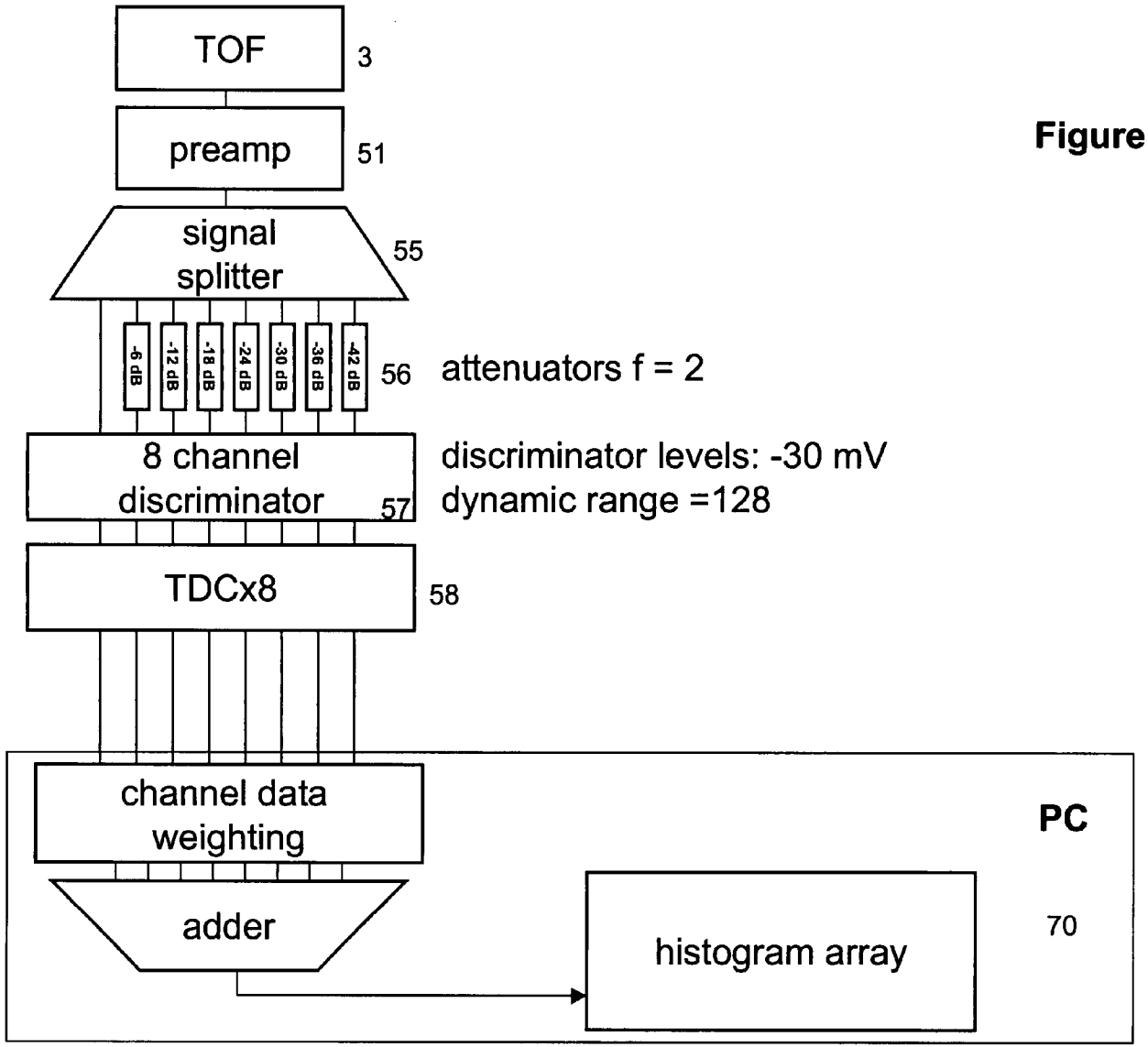
FIG. 4 illustrates an embodiment of a multi-threshold TDC system where all discriminator levels are equal and channels have different attenuation.
Figure 5:
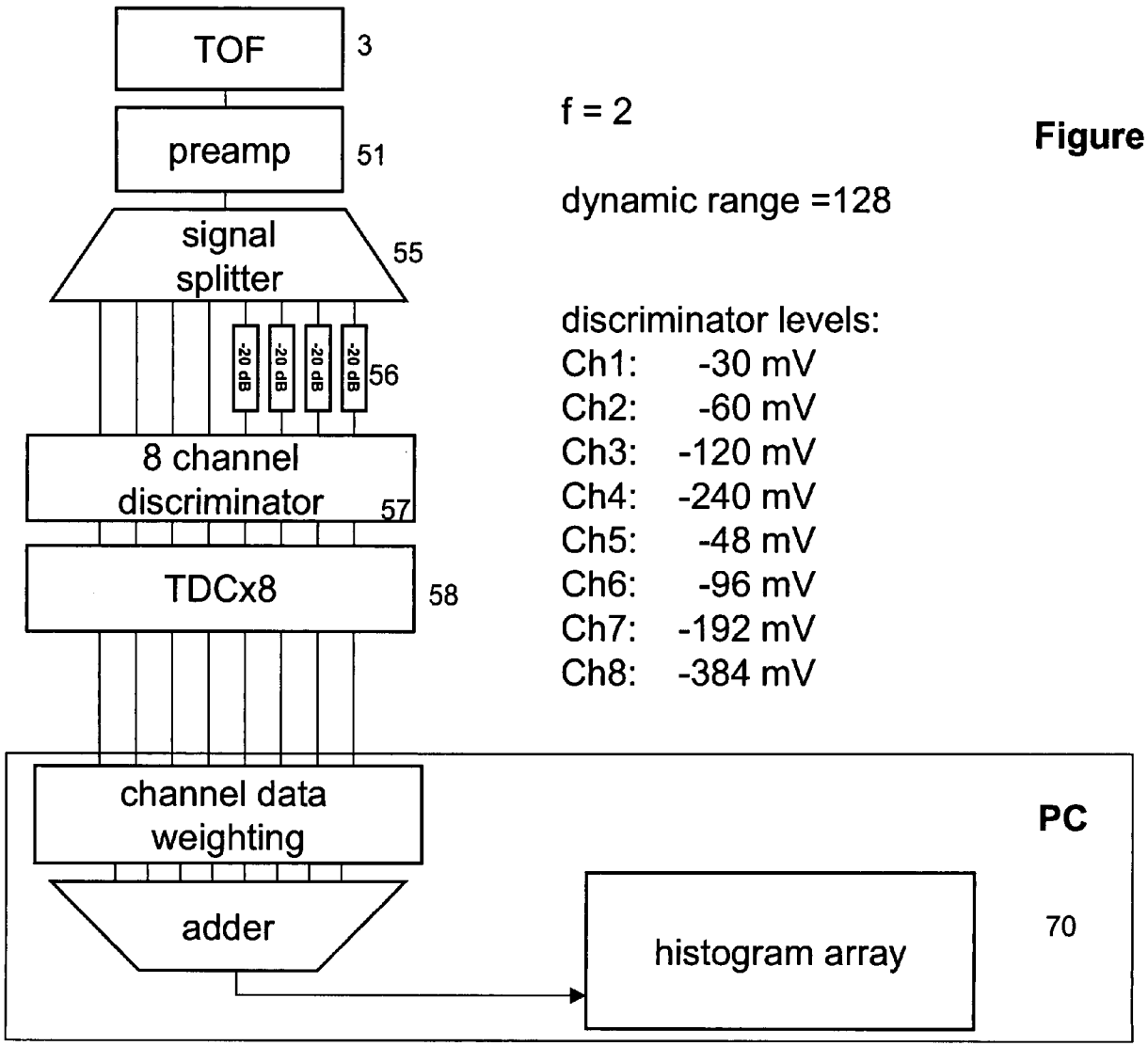
FIG. 5 illustrates an embodiment of a multi-threshold TDC system that is a combination of the embodiments illustrated by FIG. 3 and FIG. 4.

Instead of using discriminators 57 with different threshold levels, it is also possible to use different attenuation or amplification 56 on the channels, as indicated in FIGS. 4 and 5.

In some cases, it will be desirable to implement a combination of attenuators and different thresholds because most level or window discriminators have a limited dynamic range. By using attenuators on some of the channels, it is possible to further increase the dynamic range of measurement.

The multi-threshold TDC acquisition illustrated in FIGS. 2 to 7 may be used with the basic instrumental platform illustrated in FIG. 1. In order to gain some information about the number of ions in any signal peak, multiple TDC channels with differing thresholds may be used for sensing the signal peak. For example, in FIG. 2, the most intense peak is sensed by all channels except for the channel with the most negative threshold. Hence the peak height must be between −256 mV and −512 mV. The second largest peak is sensed by five channels, which means that its height must be between −128 mV and −256 mV. The more TDC channels that are available, the more accurate is the determination of the peak height. As indicated in FIG. 2, a logarithmic spacing between threshold levels is preferable because this allows maximizing the relative peak height measurement accuracy over the entire dynamic range. However, logarithmic spacing is not required, and other spacing schemes may be appropriate for other detector types.

Referring again to FIG. 3, which illustrates the electronic signal flow through the data acquisition system, the signal is created in the TOF by the ion detector. The signal is then amplified in preamplifier 51 so as to reduce noise distortions in the following electronics. The signal is then split into several channels by signal splitter 52. Each channel is then provided to a threshold discriminator or a window discriminator where a standard signal is produced in some channels. The pattern of channels that are triggered by a certain signal peak encodes the peak height. With this pattern it is possible to evaluate the peak height in computer software. For the system in FIG. 3, a −200 mV peak would trigger TDC channels 1 to 4, and hence the computer would determine that this peak had a height between −120 mV and −240 mV. With more channels, this range can be reduced and the accuracy can thus be improved.

In principle, it is necessary to transfer only the most significant channel that was triggered. Other channel signals may be suppressed, thereby reducing the data rate. Lower channel suppression can be achieved by using window discriminators (also known as Single Channel Analyzers or SCAs), by eliminating the signals in the electronics of the TDC, or by other means of processing.

In many cases, however, data rate capabilities are sufficient to transfer all triggered TDC channel signals. This then allows for reconstructing the leading edge of signal peaks in the computer, which allows for increasing the timing precision. For example, it is possible to interpolate the time when the signal reached its half maximum height.

Most discriminators have a limited dynamic range. Therefore, it is necessary in some cases to attenuate some signal lines in order to obtain a dynamic range within the dynamic range of the discriminator. By using individual attenuators 56 for each channel, as in FIG. 4, a multi-channel discriminator with a single common threshold may be used. An embodiment consisting of a combination of these two special cases is illustrated in FIG. 5.

Figure 6:
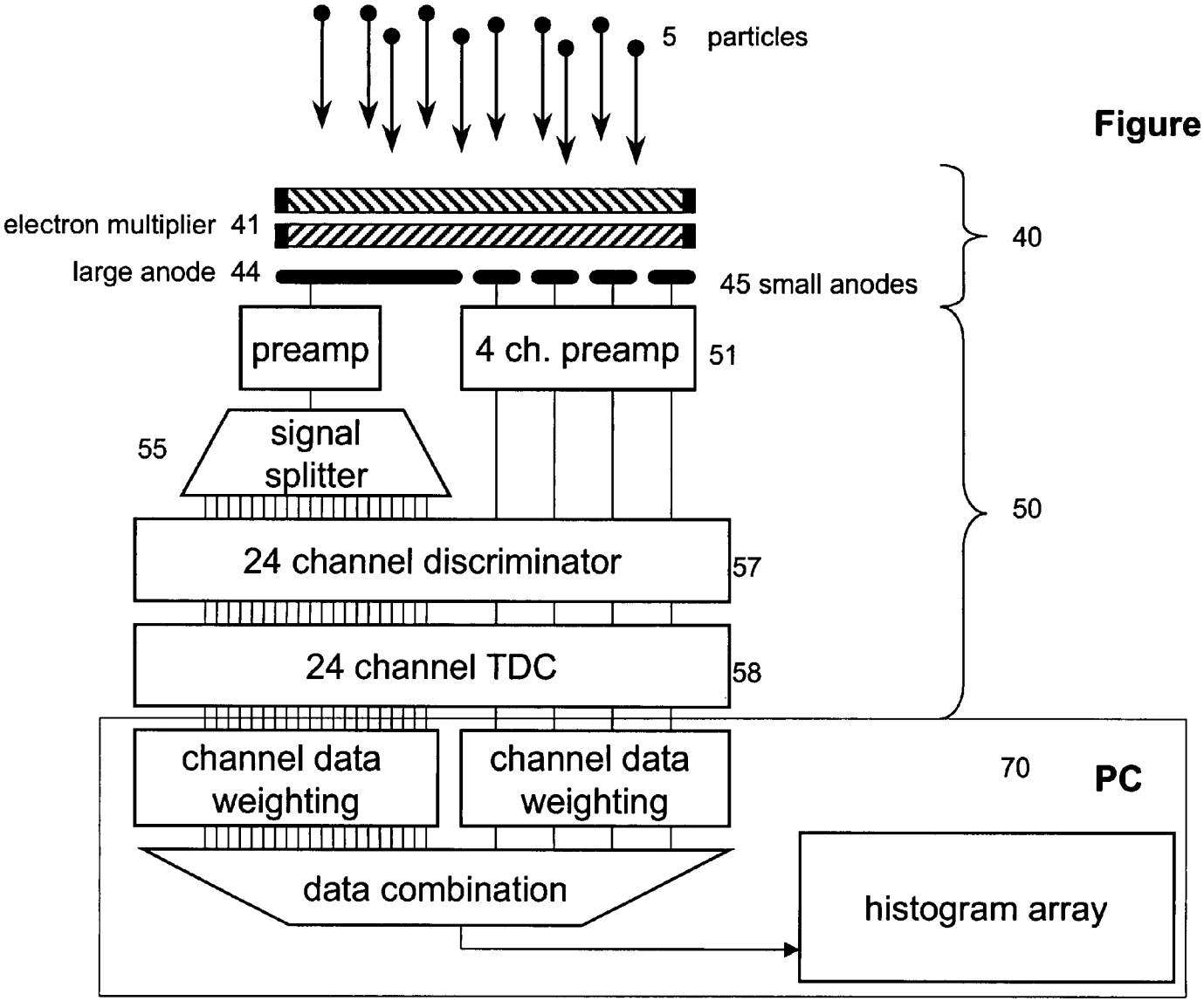
FIG. 6 illustrates an embodiment of a multi-threshold TDC method combined with a multi-anode detector method.

In the case where single ion peaks are narrower than mass peaks, it is difficult to infer the number of ions from the peak height for peaks of low ion multiplicities. For example, two single ion peaks may not be on top of each other but may be located beside each other. Then the peak height would not be increased. In other words, for low ion multiplicities, the peak height is not linear with the number of ions. Therefore, to account for low ion multiplicity peaks, it is helpful to combine the multi-threshold TDC acquisition with other methods of TDC dynamic range improvement such as a multi-anode detector including statistical correction algorithms. Depending on the ratio of single ion peak width to mass peak width, a preferred embodiment would include one large anode that is connected to a multi-threshold acquisition system, and several smaller anodes that are used to resolve low ion multiplicities. Such an embodiment is illustrated in FIG. 6. Here it is assumed that the large anode signal is nonlinear for ion multiplicities up to four (in the multi-threshold analysis). In this case, those ion peaks containing 1 to 4 ions on large anode 44 may be measured with the four small anodes 45, with additional statistical correction. A multi-anode detector with increased dynamic range for time-of-flight mass spectrometers is disclosed in pending U.S. application Ser. No. 10/025,508, which is incorporated herein by reference.

Figure 7:
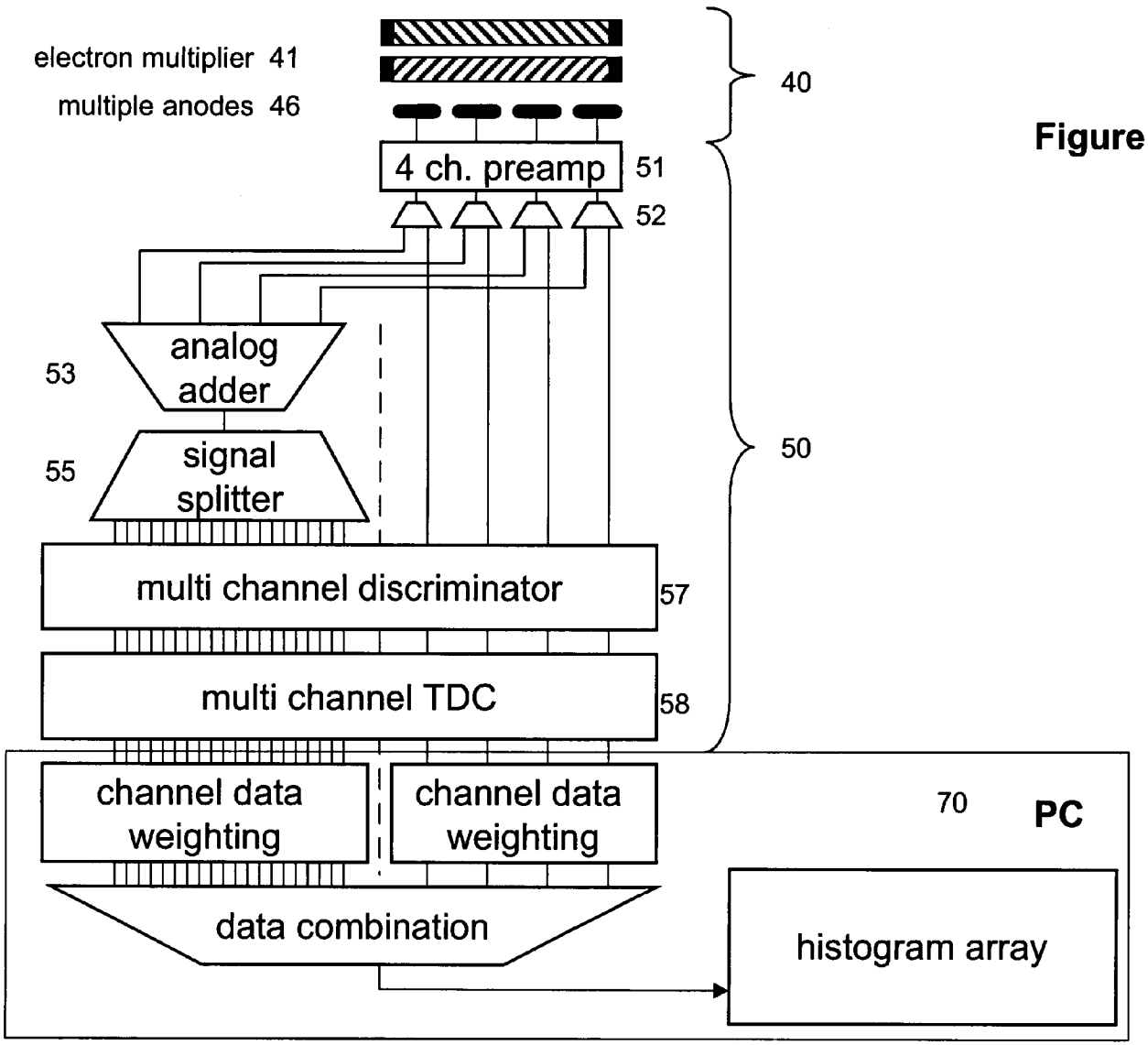
FIG. 7 illustrates a further embodiment of a multi-threshold TDC method combined with a multi-anode detector.

A further embodiment is illustrated in FIG. 7 where the physical large anode is eliminated. The large anode signal is replaced by the analog sum of all small anode 46 signals. This is done by splitting off the signal from each anode 46 with signal splitters 52 and then co-adding all channels with analog adder 53. This results in a signal that corresponds to the signal of a single large anode detector. Again, the multi-threshold acquisition is not able to reliably detect ion multiplicities of 1 to 4 ions from this signal. However, those ion peaks with up to four ions are evaluated with the conventional multi-anode detector method to the right of the vertical dashed line in FIG. 7. Ion peaks with more than four ions are evaluated with the multi-threshold electronics to the left of the dashed line in FIG. 7. Of course, this concept can be extended to more than four anodes. For example, an eight anode detector would allow for recording ion peaks with an even poorer ratio of single ion peak width to mass peak width, where multiplicities of up to eight ions are not generating a linear peak increase.

Figure 9:
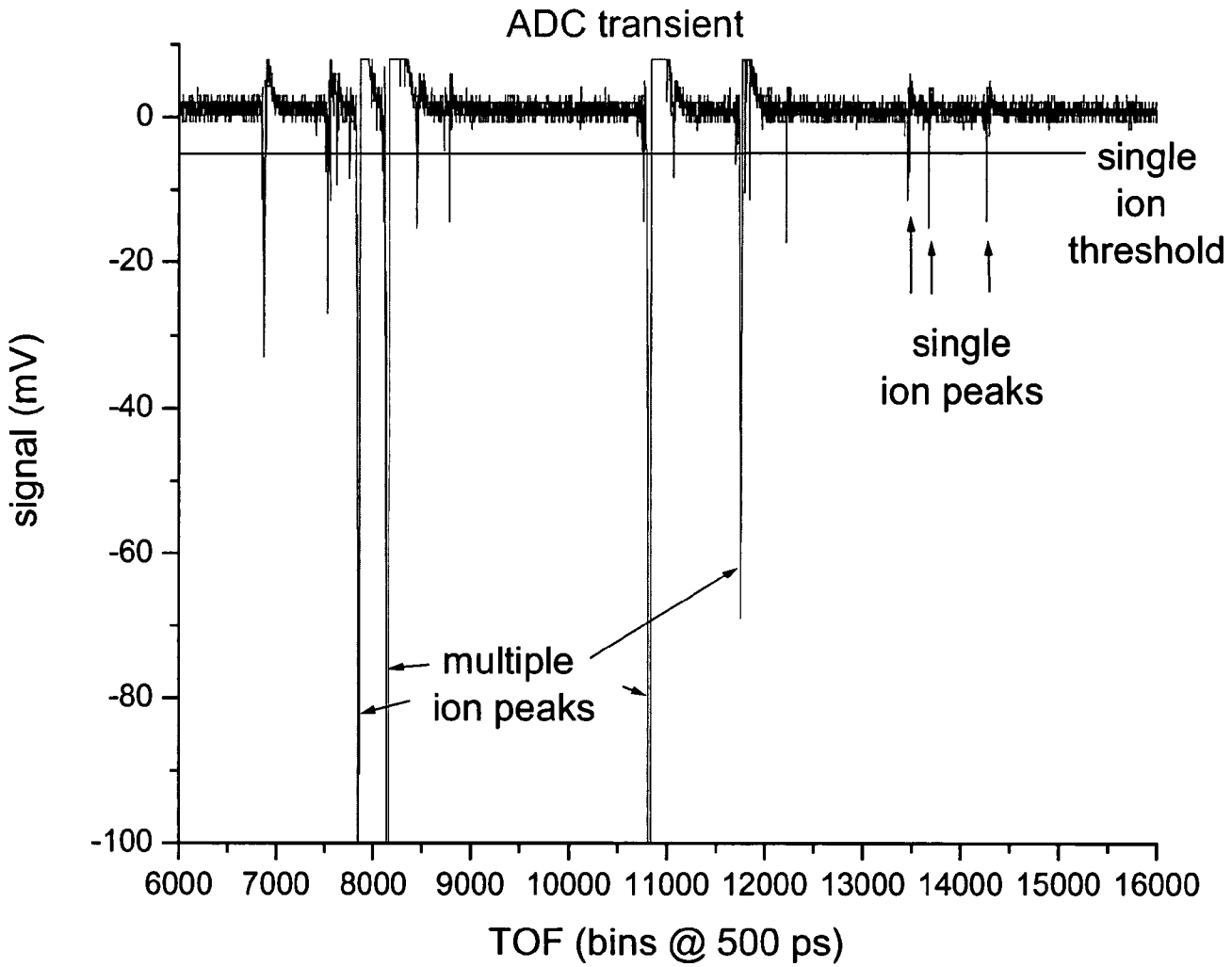
FIG. 9 is a TOF single extraction spectrum recorded with a fast ADC (2 Gs/s).

2) The ADC Method (Analog-to-Digital Converter):

The ADC acquisition scheme with decreased data rate is illustrated in FIGS. 4 and 5 and may be used with the instrumental platform shown in FIG. 1. In accordance with the present invention, only data exceeding the single ion threshold is transferred to the computer, whereas all other data is disposed. This reduces the data rate to be transferred to the computer significantly. The TOF spectrum in FIG. 9 indicates that only a small percentage of all ADC bins exceed the single ion threshold, and therefore the data transfer rate can be reduced to a few percent.

For each ion peak, the transient will exceed the single ion threshold for a certain time. This whole "peak transient" contains the useful data in the spectrum. Depending on the TOF hardware, these peak transients may be several nanoseconds long for multiple ion peaks. For single ion peaks, the peak transient is typically only 1 to 2 ns long. With each peak transient, a time flag or a bin flag identifying the position of the peak transient is transferred to the computer. With this information, it is possible to recreate the entire significant ADC spectrum in the computer.

Figure 10:
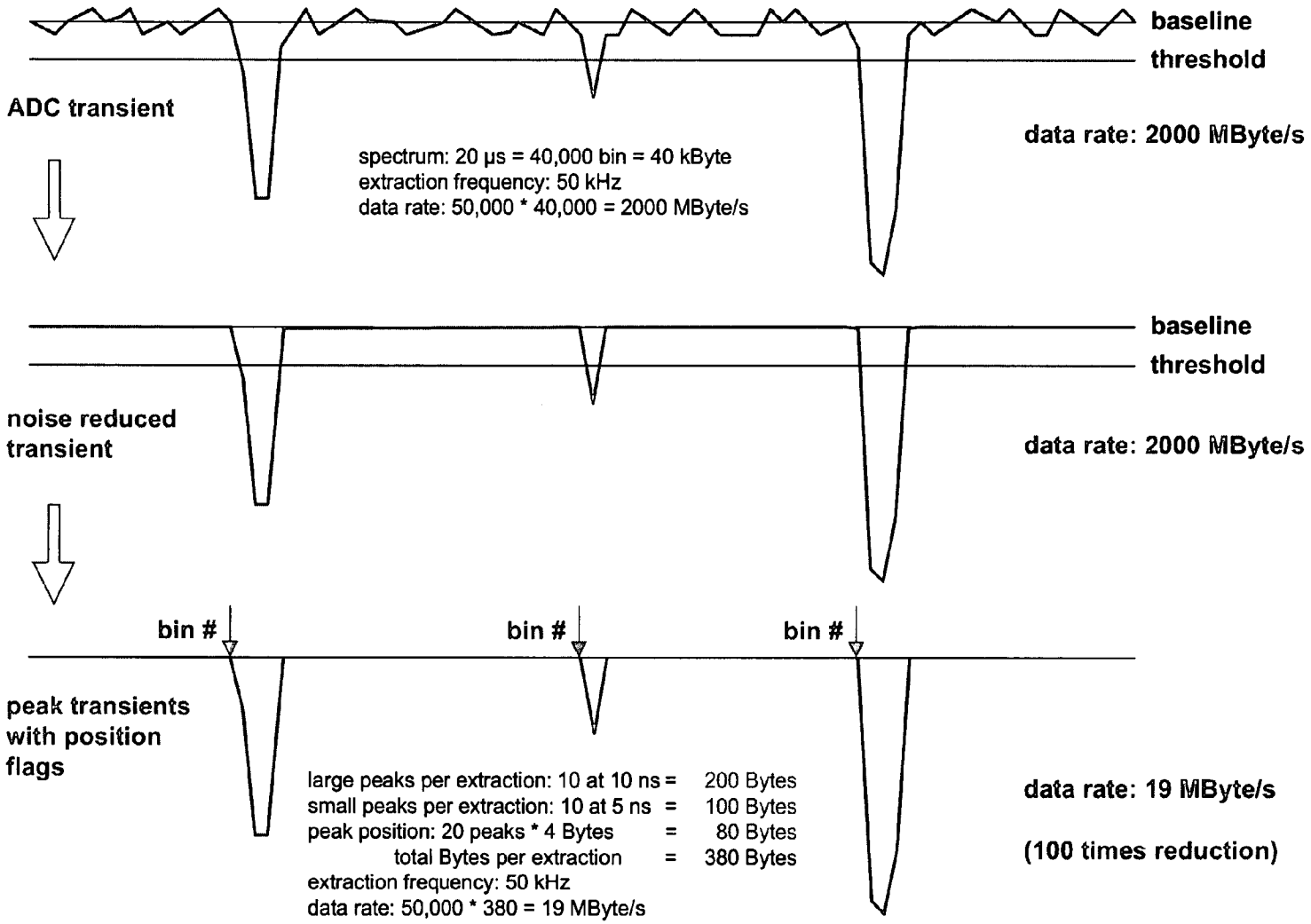
FIG. 10 is a schematic representation of an ADC threshold recording and data compression.

FIG. 10 illustrates the conversion of an original TOF ADC transient (raw data) into a transient of the same length where the noise is eliminated with the threshold recording method. This transient is then clipped into short transients, the so-called peak transients, and each peak transient is assigned a flag containing its position in the original transient. The short transients and the flags contain all relevant information and are transferred to the data processing system. FIG. 10 also illustrates that the data rate is reduced from approximately 2000 MBytes/s to approximately 19 MBytes/s.

In principle, compared to a TDC data acquisition, this threshold ADC acquisition has several advantages: 1) there is no dead time as occurs with many TDCs, 2) the peak shape can be reproduced and further evaluated in software, making it possible to extract two mass peaks from a hardly resolved double peak, and, 3) accurate peak position may be determined by evaluating peak centroids.

Compared to the multi-threshold TDC data acquisition discussed above, this threshold ADC acquisition has the disadvantage that the dynamic range is limited by the 256 levels that can be encoded with an 8 bit ADC. However, the reduced data transfer requirements allow for using two 8 bit ADCs in parallel, or, should they become available, the use of fast 10-, 12-, or more bit ADCs.

Compared to an ADC system that transfers only the peak position and the peak area to the computer, the transfer of peak transients allows for sophisticated peak evaluation to be done in the computer. Hence, only the transfer of peak transients allows for evaluation of hardly resolved double peaks.

Figure 11:
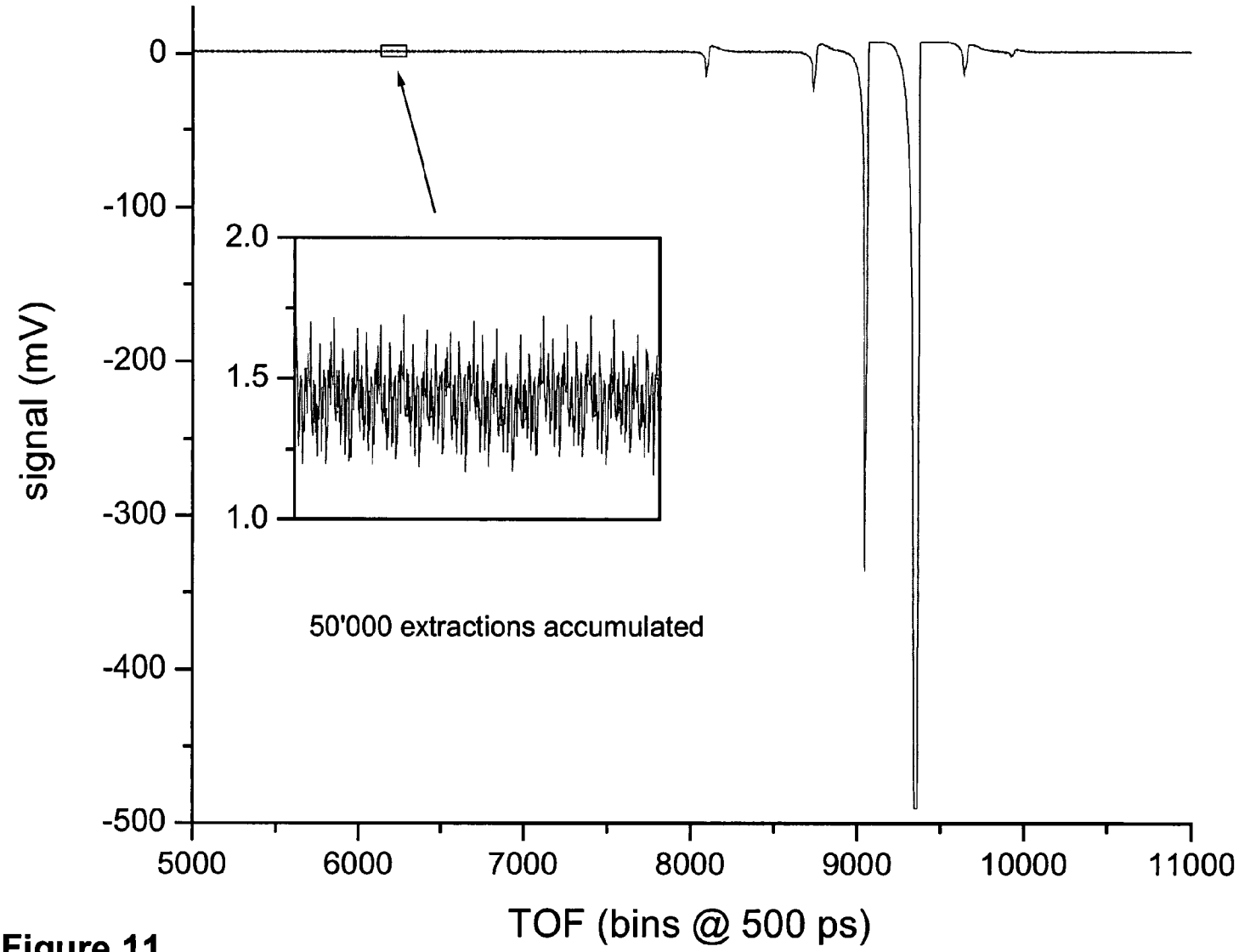
FIG. 11 illustrates a time of flight spectrum taken with a ground referenced ADC available commercially from Acquiris. The noise in the baseline is greater than the amplitude of many of the smaller unamplified electron pulses generated from single ion events at the detector.

A further disadvantage of this threshold ADC acquisition scheme is shown in FIG. 11, which shows that the combined noise floor comprises several mV of excursion. FIG. 11 illustrates a time of flight spectrum taken with a ground referenced ADC available commercially from Acquiris. This noise floor is equal to the unamplified single height amplitude of many single ion events. This detection efficiency loss can only partly be recovered when the detector output is further amplified after it leaves the detector. This problem is exacerbated when the detector anode output is floated to high voltage, thus producing a "sloping" noise floor and/or when high voltage pulsing is applied to the detector itself (in the case of detector blanking) or is applied in the vicinity of the ion detector (in the case of the orthogonal extraction high voltage).

3) Combinations of the ADC and TDC Methods:

The two methods discussed above may be combined in several ways. In one embodiment, a TDC detects an ion peak and triggers the recording of the peak transient with one or several fast ADCs. In another embodiment, a TDC and a fast ADC work in parallel, resolving low ion multiplicities with the ADC and increasing the dynamic range with a multi-threshold TDC.

4) Further Multiplication Stages:

CuBe (or other discrete dynode material) meshes may be used as a further multiplication stage behind two or three multi-channel-plates in which the second (or the second and the third in the case of a triple stack) are operated in a linear mode (i.e., by applying a bias voltage to these second or second and third plates that does not produce gain saturation). In this configuration, simultaneous multiple ion collisions will produce discrete maxima and minima on average in the pulse height distribution of the electrons coming out of the hybrid multiplier. This effect is particularly enhanced if a high secondary electron producing material such as thin film GaN implanted with lithium is added to the front of the multiplier and if this film is reversed biased as shown in FIG. 19.

Figure 19:
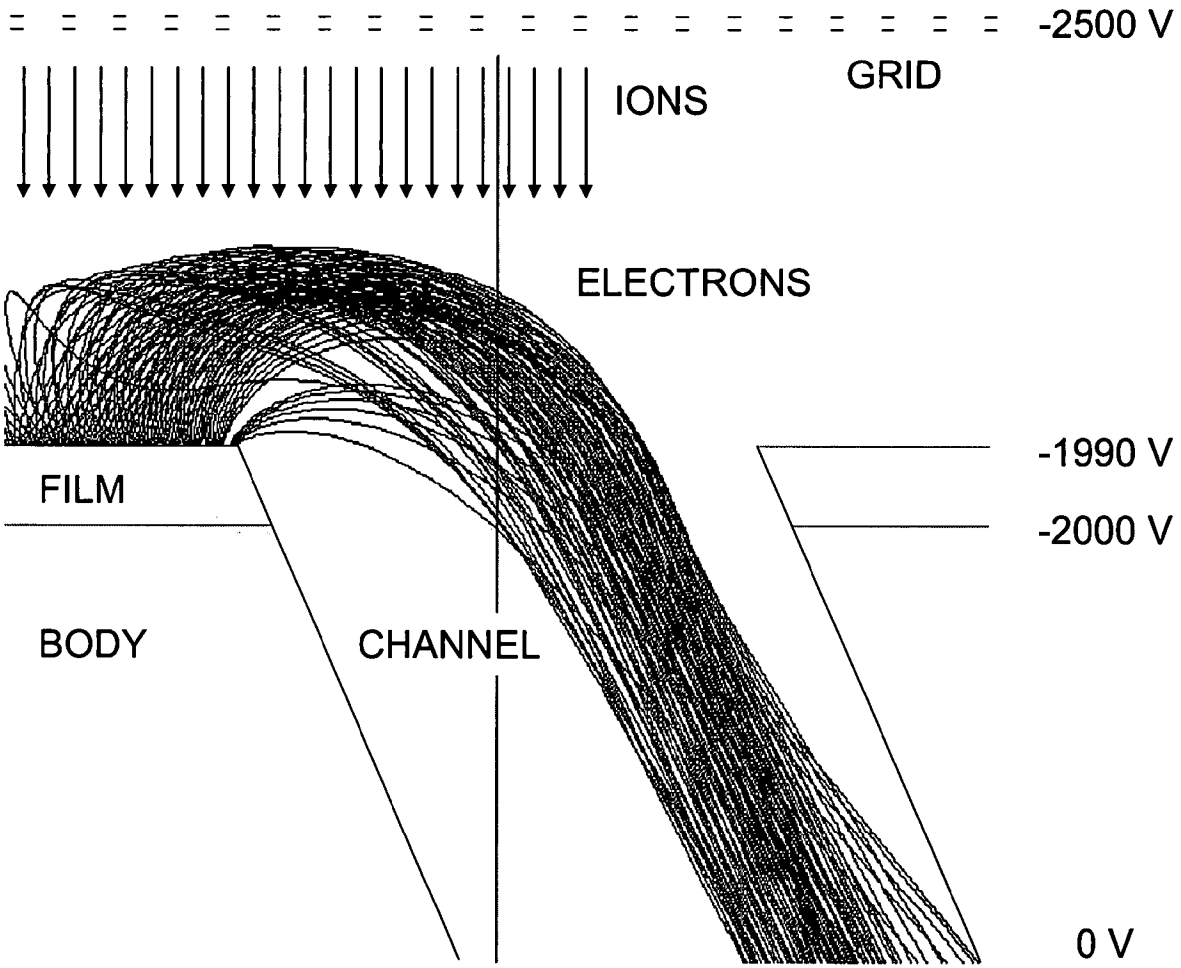
FIG. 19 shows a collection of the secondary electrons produced on the surface of an MCP plate from the "Web Area" between the channels, with the electrons then being focused into the channels using a film coating and a high transmission grid above the surface.

The detection probability of conventional MCP detectors can be improved by depositing ultrathin nitride layers on top of the MCP as shown in FIG. 19. The use of efficient AlGaN converter coatings may be used to fabricate compact effective large mass ion detectors, which do not require any additional conversion stages. An additional high transmission grid close to the MCP surface helps to refocus the electrons produced in the area between channels back into the channels as shown by the simulation in FIG. 19. Specifically, FIG. 19 shows a collection of the secondary electrons produced on the surface of the MCP plate between the channels into the channels using a film coating and a high transmission grid above the surface. The trajectories for secondary electrons having an energy of 3 eV are shown. The actual grid-MCP separation is 0.5 mm, which is not shown to scale in FIG. 19.

Figure 20:
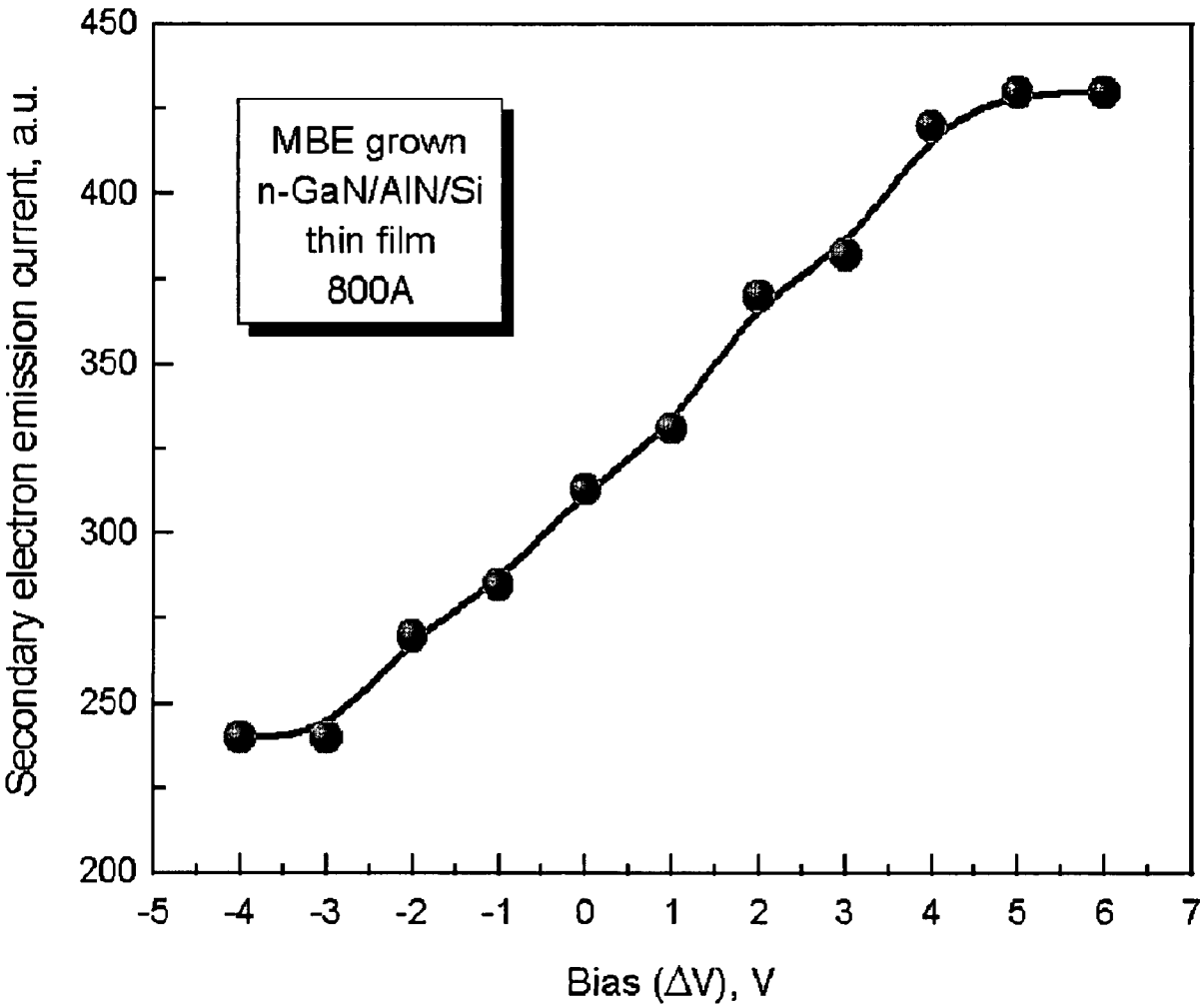
FIG. 20 shows the results on the dependence of the SEE current as a function of bias for a n-GaN/AlN/Si structure.
Figure 21:
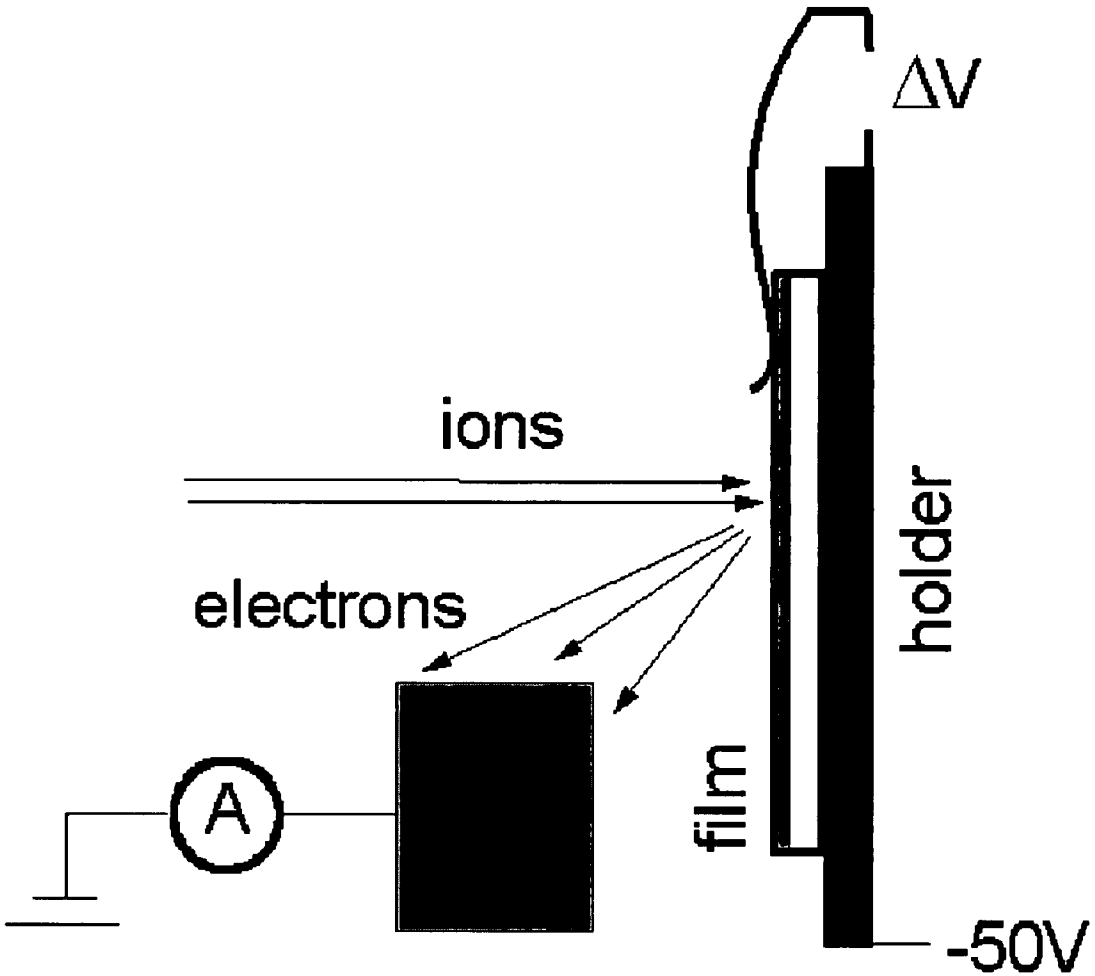
FIG. 21 shows the measurement setup used to obtain the results in FIG. 20.

An even higher secondary electron emission ("SEE") yield can be obtained if the thin film is reverse-biased. The enhancement/suppression of secondary electron emission from nitride films under a voltage bias is shown in FIG. 20. The SEE yield from n-GaN/AlN/Si thin films increase upon applying a negative voltage bias and decrease upon applying a positive voltage bias. A bias value, corresponding to an internal electrical field strength of 50 V/μm, results in a 100% increase in the SEE yield. This effect may be attributed to the bending of the band structure near the film surface, which increases the electron tunneling probability through the potential barrier. A dual use for the detector structure is rendered possible depending on the bias direction. While in a forward bias the structure acts as a detector, in the reverse bias it acts as an ion impact induced electron emitter. Extending this result to higher order superlattices, this effect may be amplified by using the higher order graded AlN/AlGaN/AlN superlattice structures in a reverse mode to sink electrons from the substrates towards the surface. In the case of ultra thin films, very low voltages (less than 10V) may be needed to obtain a change in the yield value. This effect can be used to both enhance the detection efficiency of the MCP detector and to produce efficient ion-electron converters with adjustable gain. FIG. 21 shows the measurement setup, and FIG. 20 shows the dependence of the SEE current as a function of bias for a n-GaN/AlN/Si structure. Furthermore, use of the relatively low thin film bias voltage is a convenient way to quickly "blank" or reduce the gain of the detector when high intensity ion peaks are known to arrive at the detector.

An additional SEE gain from the film can be obtained if low energy lithium (or other alkali) ions are implanted after nitride thin film deposition or are codeposited during nitride thin film deposition. The secondary electron yield increases over that obtained from the undoped nitride films. Another feature of either the nitride film or the lithium implanted nitride converter film is the production of either positively or negatively charged hydrogen ions. It is well known that the hydrogen sputter ion yield is larger than the electron yield from most materials. That is, for a specific ion collision, the probability of producing either a positive or negative (or both) hydrogen ion from the region of the collision site is higher than the probability of producing electrons. This is especially true as the mass of the ions becomes larger (e.g., proteins or other bioions). Researchers have made use of the secondary hydrogen ion production from a converter plate as a way to detect large bioions.

The nitride or alkali implanted thin film could be used as a high voltage biased converter plate in such an application. The nitride thin film converter plate would be biased to a high negative voltage to accelerate the large positive ions to the highest possible velocity during impact with the converter plate. The secondary electrons and negative hydrogen secondary ions would then be accelerated away from the converter plate into a magnetic field that would deflect the secondary electrons onto a pixilated detector. The magnetic field would also deflect the negative hydrogen secondary ions away from all other secondary ions that were produced from the converter plate. These hydrogen secondary ions would then be focused into an energy compensating time of flight analyzer (which could be, for example, a reflectron or a series of time and angle refocusing sectors). The output of the detection of the hydrogen secondary ion for the ion detector of this time-of-flight analyzer could then be correlated within the data analysis hardware and software to the arrival time of the large positive ion on the nitride converter surface since the flight time of the accelerated hydrogen secondary ion through the energy compensating time of flight analyzer is constant for given fixed voltage parameters in the time of flight analyzer.

The use of the lithium (or other alkali) doped nitride film is particularly useful in this application because it tends to promote high negative (and positive) hydrogen secondary ion yields. Those of skill in the art will understand that the converter surface and all other associated voltages for the detection of positive ions from the converter surface may be achieved by reversing all acceleration potentials and magnetic fields.

Figure 23:
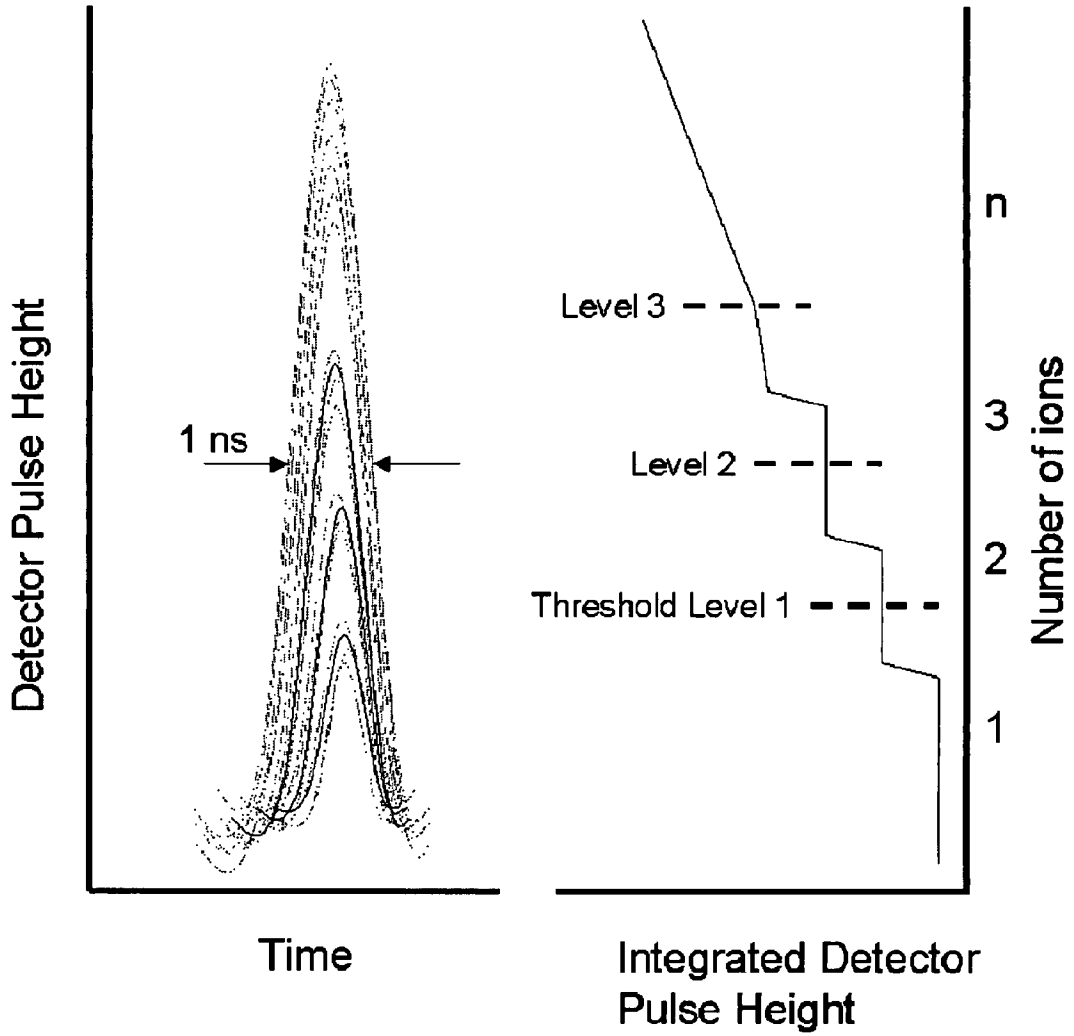
FIG. 23 shows a schematic of the pulse height voltage from a detector when one, two, three, and many ions arrive simultaneously at the detector surface above a particular anode. Discrete ions can be counted by positioning threshold levels at appropriate values. The rundown circuitry would be triggered above level 3 in this depiction.
Figure 24:
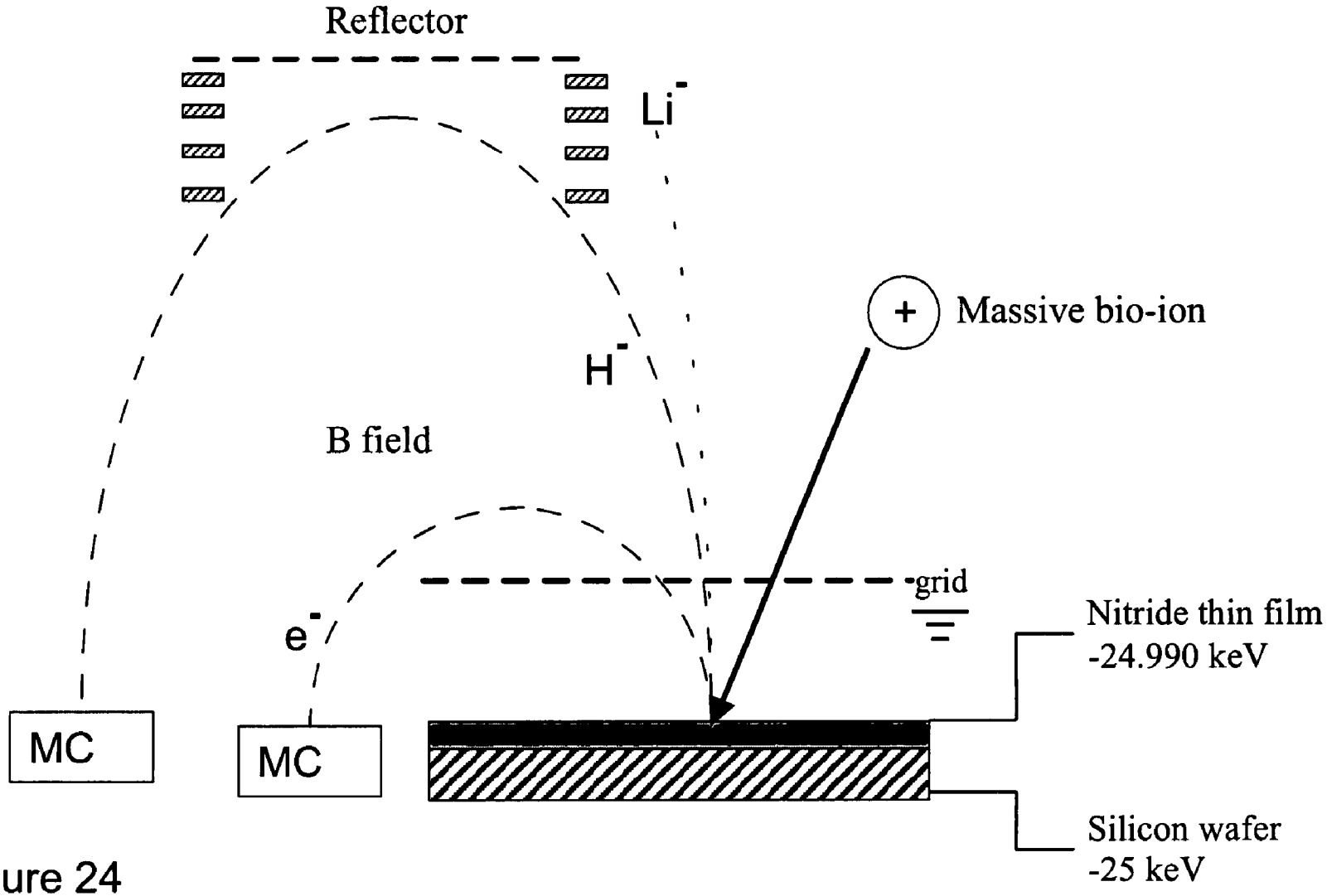
FIG. 24 shows a schematic of a reverse biased nitride flat plate converter with secondary electrons and hydrogen ions being transported to different detectors.

Thus, multiple secondary electrons are ejected when an ion hits the first plate so that the narrowing of the Poisson distribution as a function of average number is then reflected in the narrowing of the pulse height distribution of the subsequent electron clouds emerging from the hybrid multiplier. This "single ion" pulse height distribution is determined by measuring the pulse height of each electron cloud in response to each of many ions of the same mass as each ion hits the detector. The pulse height distribution is then a plot of the frequency of each electron pulse height amplitude as a function of the amplitude of the electron pulse heights (which may be measured either as a current or a derived voltage). The plot in FIG. 23 shows the difference between the average pulse height when one ion of a mass peak strikes the detector compared to the larger pulse height when two or more ions simultaneously strike the detector above a single anode.

The result is that, for example, three simultaneous ions of the same mass will have a combined electron pulse height distribution out of the hybrid detector that is very nearly three times the average height of one ion hitting the detector. Thus, if three different discriminator levels are established, then the individual ions may be counted even if they hit above the same detector anode at the same time. In a time of flight mass spectrometer, the ions of all masses are accelerated with the same potentials to very nearly similar energies. Since the detector efficiencies are proportional to the velocity of an ion, the pulse height distributions also are ultimately a function of the ion velocity.

Another advantage of using this hybrid detector comprising the combined MCP and CuBe (or other discrete dynode material) discrete mesh multiplier is that the number of electrons impinging each anode can be up to $10^8$ instead of only up to between $10^6$ and $10^7$, which is the maximum that can be achieved with an MCP triple stack arrangement for a single ion event. This extra order of magnitude amplification obtained by combining the two detector types (while not significantly degrading the timing resolution of the detector) very importantly permits decoupling of the anodes when they are at a very high voltage. One of the significant challenges of time of flight mass spectrometry in general and orthogonal time of flight mass spectrometry in particular is that the detection of heavy ions is aided by accelerating the ions at the highest possible energy into the detector. In any practical modern spectrometer this requires the front of the ion detector to be at a high potential of several 10's of keV and of opposite polarity to the ion to be detected. The practical problem is that this then requires that the anodes also be at a high voltage, and this requires some means (usually capacitive or inductive decoupling) for decoupling the voltage produced by the electron pulse from the high voltage anode so that its arrival time at the anode (as well as its amplitude) can be recorded by ground referenced electronics. Modern PIN diode optoisolaters may be used for optically decoupling the anode pulse from the timing circuitry. Although the rise time of the transmitters in the optoisolator circuitry is fast enough, the diodes are not sensitive to less than $10^7$ electrons. Therefore, only about 20% at most of the single ion events are detected by a triple stack MCP that is optoisolated in this fashion. See, for example, "Optical signal coupling in microchannel plate detectors with a subnanosecond performance," Peter Wurz and Reno Schletti, Rev. Sci. Instruments 72(8), 3225ff, August 2001. By contrast, the additional order of magnitude gain by the hybrid detector described herein will allow present day fast optoisolaters to be used.

Another feature of the hybrid detector is that it is one of the best noise free linear amplifiers available. Use of the hybrid detector for this application eliminates or reduces the need for preamplifier 51 in many applications, including all of the multilevel threshold detection methods described herein.

5. Combinations of the Hybrid Detector with Analog to Time Conversion and TDC Time and Amplitude Measurements An alternate approach to combining TDC and ADC is to use the Wilkinson Analog amplitude-to-time ramp rundown circuitry that measures pulse height distribution in a manner well known to those of skill in the art. Although this technique has been successfully used for many years, it has been abandoned for time of flight applications primarily because of the length of time (50 to 100 nsec) required to accurately encode the electron pulse amplitude from the detector, thereby precluding the detection of additional longer time of flight mass peaks that might be within this "deadtime" window of 100 nsec. However, as described herein, the present invention overcomes this problem.

Figure 12:
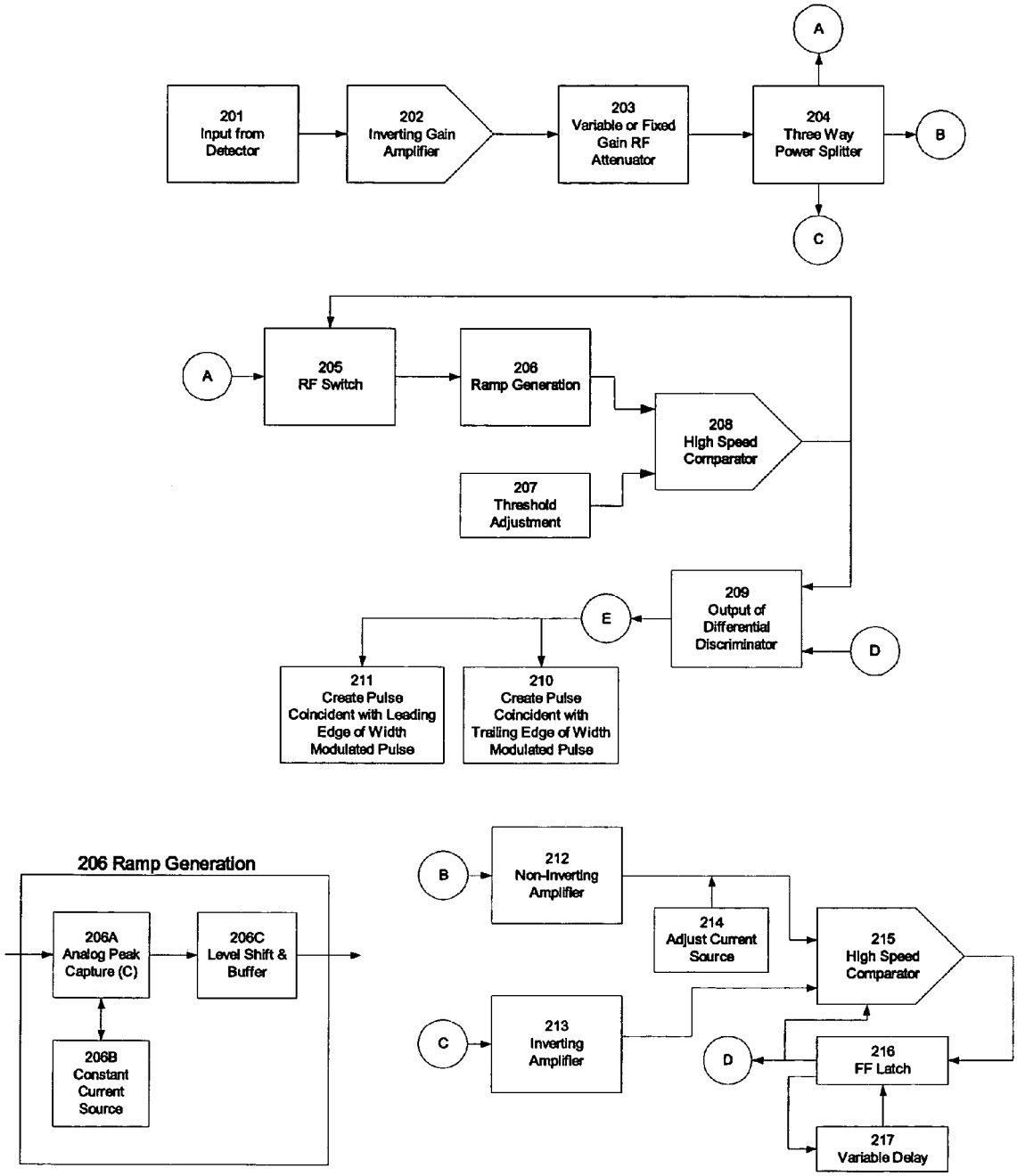
FIG. 12 illustrates a rundown circuit with a differential discriminator.

FIG. 12 illustrates a rundown circuit with a differential discriminator. The output 201 of an ion detector could either be the signal following preamplification by preamplifier 51 or the unamplified ion signal directly from the TOF anode(s) 44. Use of an un-preamplified signal would have the advantages of presenting less noise to the measurement circuit and enabling better time measurement. The preamplification function could be incorporated into the function of the Amplifier 202 of the discriminator circuit. Amplifier 202 is an inverting RF amplifier, which creates a positive-going signal from the negative-going ion input. This is followed by either a fixed or adjustable RF attenuator 203. The amplifier/attenuator combination is selected to provide enough gain to overcome signal loss in the three-way power splitter 204 following the attenuator. The gain should not be so great, however, that it would limit the dynamic range of the "rundown" circuit. Preferably, the rundown circuit would operate in a typical fashion with the following exceptions: First, the peak capture and ramp generation would be level shifted to utilize the full dynamic range of the high-speed comparator. One embodiment uses only about 40% of the maximum voltage that the ramp could be "rundown." Second, higher voltage capable RF transistors and amplifiers would be used in the ramp generation circuit so that larger voltages may be applied to the comparator.

Output A from the three-way power splitter 204 is applied to an emitter-follower RF switch 205 whose purpose is to "lock-out" further input to the ramp generation circuit 206 once a peak has been determined to meet the minimum threshold for activation of the amplitude measurement. The RF switch will be gated on except during the analog measurement or "rundown" interval. The output of the RF switch is AC-coupled to the peak capture circuit 206A, which consists of an emitter follower whose output (emitter) is connected to a current source 206B in parallel with a known capacitance (C). The combination of current source and parallel capacitance constitutes an RC time constant. In operation, an ion peak will charge C to the maximum voltage contained within the peak. Then, as the ion peak rapidly decreases in amplitude (ion peaks are typically 3 ns in width at their base), the emitter follower becomes reverse biased and presents a high impedance to C, which must now discharge slowly through the current source. It is by virtue of the emitter follower only being capable of sourcing current that the peak capture is possible. The metered discharge of C via the current sink is referred to as "ramp" generation (or "rundown"). The ramp is then buffered and applied to one input of an analog high-speed comparator 208. The other comparator input is fed with an adjustable DC offset 207 that is used to set the threshold of minimum peak detection. The comparator 208 changes its output sense upon detection of the initial peak capture and does not change its output sense back to a resting state until the ramp is discharged below the set threshold. In this way a pulse is created with a width that is dependent upon the amplitude of the peak that has been captured.

The width-modulated pulse E would be suitable to route directly to a time to digital converter with rising and falling edge measurement capability. By utilizing rising/falling edge measurement, the "rundown" circuit is simplified and the number of TDC channels used is conserved. If such a TDC is not used, circuit 211 creates a pulse coincident with the start of the width-modulated pulse for input to one channel of a TDC. Circuit 210 generates a pulse coincident with the end of the width-modulated pulse E.

Output B from three way power splitter 204 in FIG. 12 is applied to a noninverting amplifier 212 while output C is applied to an inverting amplifier 213. This gives two time aligned signals of opposite polarity, which are then applied to the differential inputs of a high-speed comparator 215. After amplification, output B is offset by use of an adjustable current source 214. The polarity of the offset is applied such that when an ion pulse enters the circuit the voltages at the two inputs of the comparator will converge and then cross each other in the case where the amplified ion peak exceeds the introduced offset. This will cause the output sense of the comparator to change and signifies the detection of an ion.

The output of the High Speed Comparator 215 is presented to a flip-flop latch 216 arranged in conjunction with Variable Delay 217, which is adjusted to produce an output signal of known, constant duration when the comparator output signals detection of an ion. The differential discriminator circuit in 212–217 could be used for single-ion measurement by applying signals directly from the Amplifier 202 to the inputs B and C of amplifiers 212 and 213.

Figure 13:
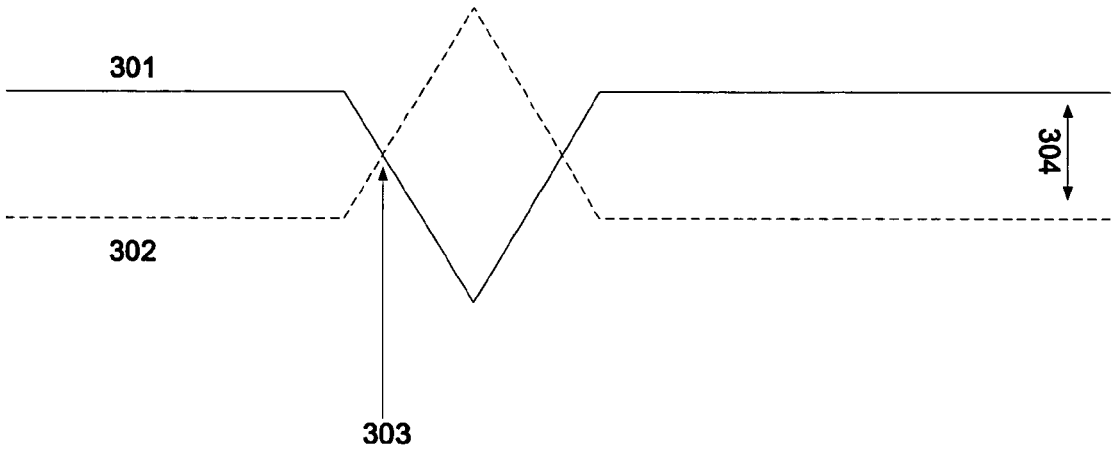
FIG. 13 illustrates how the circuit of FIG. 12 may be used for ion detection.

The differential discriminator comparator input scheme is shown in FIG. 13, where 301 is the non-inverted input and 302 is the inverted input. The comparator inputs cross at point 303, and the offset is shown by 304. This method of ion detection has several advantages over traditional level crossing or CFD (constant fraction discriminator) implementations of ion discriminators. By using the comparator in a differential mode, noise immunity and rejection of common mode noise is improved. Also, it can be seen in FIG. 13 that the rate of closure (voltage change) between the comparator inputs is greatly increased over a detector utilizing a fixed threshold voltage. This increased rate of voltage change causes the comparator to exhibit low "walk" for ions of varying amplitudes and is the same problem addressed in a zero crossing CFD, but with the added noise immunity benefits and with simplified construction, i.e., no external delay cables or circuit is necessary. The output of the comparator is then latched and held while an output pulse is generated. Upon completion of an output pulse, the comparator is re-enabled for another ion.

One embodiment incorporates the differential comparator technique into the detection of the width modulated pulse from the rundown circuit. Ramps with similar characteristics, except of opposing polarity, are applied differentially to the inputs of the high-speed comparator. Benefits of this embodiment include increased accuracy of threshold timing and temperature tracking of the two ramps to increase timing stability. In another embodiment, the rundown circuit is duplicated with differing threshold levels to cover a wider dynamic range than is possible with a single ramp circuit.

By measuring the pulse height when one (or more) ions simultaneously strike the anodes and saving the arrival time and amplitude in a list mode acquisition, it is possible to create software histograms and to define voltage levels within the amplitude measurements that count single, double, triple, etc. simultaneous ion arrivals. This post-processing has the advantage that the levels can be defined differently for different ion masses since the electron output intensity from the hybrid detector will be mass (velocity) dependent.

Figure 22:
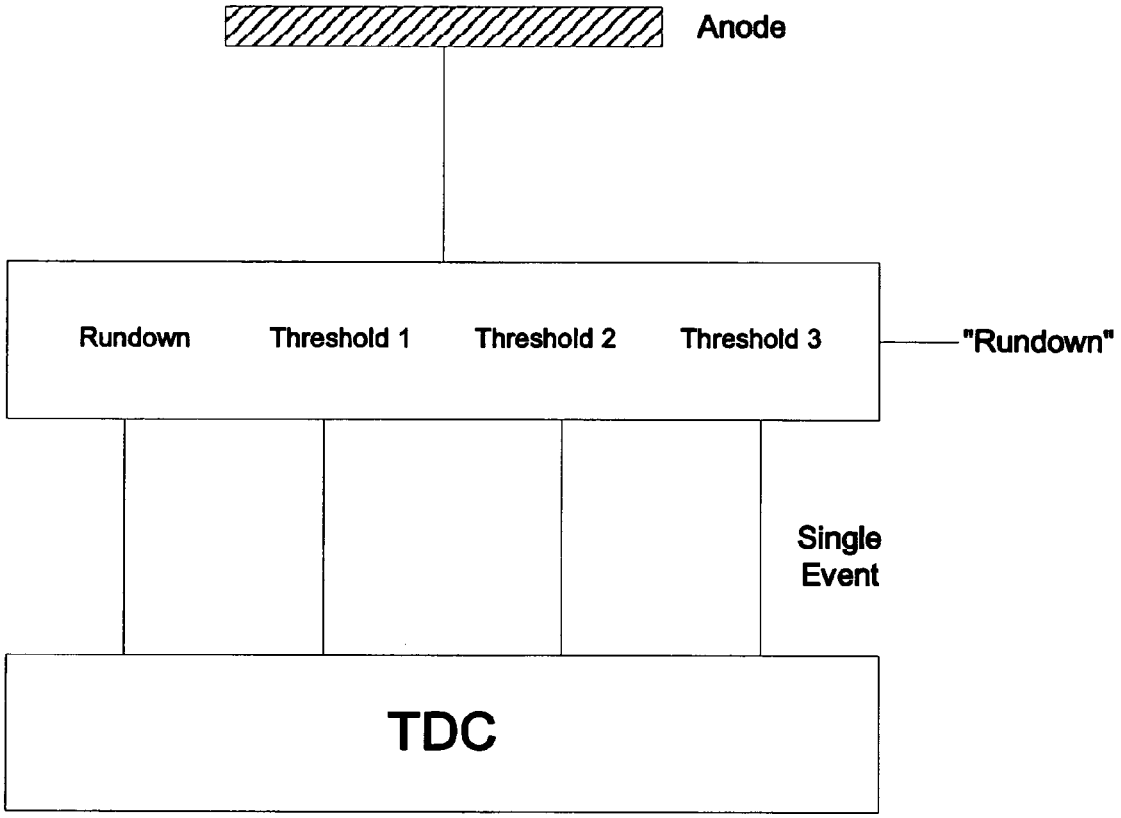
FIG. 22 illustrates an embodiment of the present invention with more than two threshold levels.

Clearly, several such analog to time converter/discriminator combinations shown schematically in FIG. 22 could be added to each individual anode. For example, the combination shown in FIG. 22 would replace in FIG. 7 the following discrete items: preamplifier 51, splitter 52, analog adder 53, and signal splitter 55. The levels at which the rundown circuit would trigger could be matched to a smaller subset of the levels shown in FIG. 2, for example, thereby enabling higher analog measurement accuracy while using fewer TDC channels.

A further advantage to having each anode equipped with a fast Wilkinson amplitude to time converter is that a limited dynamic range (100, for example) can be measured extremely quickly from each anode. This advantage would allow several hundred ions to all be "counted" with high accuracy.

This hybrid detector coupled with a limited number of anodes with which the time and amplitude of each mass peak is recorded by the amplitude to time converter would thus solve one of the longstanding problems in time of flight measurements—namely, how does one measure an isotopic ratio with a dynamic range larger than the detector linearity? The linearity of the MCP combination is only at best seven orders of magnitude. With the disclosed arrangement it is possible to obtain at least 10 orders of magnitude, with additional increases possible if the small/large anode concept is also used (again, with its own amplitude to time converter).

Finally, it is possible to intentionally defocus the electron cloud onto several nearest neighbor anodes within a pixellated (64 or 256 anodes, for example) anode array. This is done (instead of trying to make sure that the electron cloud is on only one anode) so that the assembly can be used as a fast and high resolution position sensitive detector as described below. The fraction of the charge cloud that is shared by nearest neighbor electrodes is measured using, ideally, the Wilkinson amplitude to time converter attached to each anode. Reconstructing the amplitude from all nearest neighbors provides the total electron pulse height distribution (so no information is lost regarding the number of ions that have hit the detector). In addition, even if the anodes themselves are several hundred microns wide (0.5 mm, for example), one can accurately measure the point of impact of a single ion (or the different individual ion impact positions if there are more than one ion in the mass peak) to a few 10's of microns accuracy by centroiding the charge that is distributed over nearest neighbor anodes behind the point of impact of an individual ion of the detector face. This technique may be used either with pixel arrays with a meander delay line in front of the array or with the array itself with no meander delay line at all. The high dynamic range of the combined detector and electronics discussed above would also be possible with this application as well.

The present invention overcomes the dynamic range limitations of time of flight mass spectrometry using a hybrid data system consisting of low-noise single ion pulse counting using time-to-digital techniques and real-time analog signal amplitude analysis. In conjunction with a combined micro-channel-plate/discreet multiple-anode ion detector, this hybrid solution provides a combination that both prevents detector saturation and preserves ion amplitude information without the penalty of excessive data rates resulting from parallel simultaneous acquisitions by both TDC and analog implementations. The spatial footprint of this hybrid data system is well suited for miniaturized instruments.

As described above, a simplified and scalable pulse amplitude-to-time conversion circuit is provided that operates in conjunction with existing time-to-digital converters and allows event-by-event estimation of the voltage amplitude of the detector event pulse for single and multiple ion detections. In particular, event input signals from the detector anode (either unamplified or with external amplification) are presented to a ramp conversion circuit that detects and holds the peak voltage amplitude exceeding the noise threshold and generates a reference time pulse. The voltage amplitude is then discharged at a constant rate, and when it falls below a threshold, a timing pulse, delayed relative to the reference pulse, is generated. The delay between the two pulses is a function of the amplitude of the original input event. These pulses are level-translated into a form suitable for direct input to the existing TDC, which measures the time interval. A parallel single-event channel is used for capturing low amplitude detector signals that arise when only one ion hits the detector.

The converter circuit described herein is an embodiment of an A/D converter that has some important advantages for mass spectral instrument applications. First, the peak-amplitude capture mechanism operates on the same time scale as the events of interest (anode current pulses). This capture mechanism would have been required in some form (e.g., sample-and-hold or track-and-hold) even with an explicit A/D converter in order to capture event amplitude information that is of much shorter duration and occurs randomly with respect to an A/D converter sample clock. Second, the amplitude-to-time conversion process happens "on demand" only when an input event actually occurs. This reduces the amount of post-processing data handling since only measurements of interest are present in the data stream. Third, amplitude information is converted to the digital time domain using the same time-to-digital converter circuits that are used with existing mass spectrometers. Fourth, amplitude information appears in the digital data stream in close association with the original time-of-flight measurement. This greatly simplifies post-processing logic since no additional synchronization or decision-making based on disparate data streams is needed. A relatively straightforward addition to existing data collection and display software programs permits the operation of the circuit to be verified with actual TOF data very rapidly. Fifth, the circuit is readily reproducible for a multiple-anode configuration, regardless of whether that configuration is of the existing large-and-small anode design or multiple equal-area anodes. The ramp converter circuit is designed to replace the discriminator function of the analog signal chain and presents its output in a form readily handled by existing and future time-to-digital converters. Copies of the same circuit on multiple anodes should also improve overall instrument reliability since a single-point failure should be less likely to completely inactivate the instrument.

Figure 17:
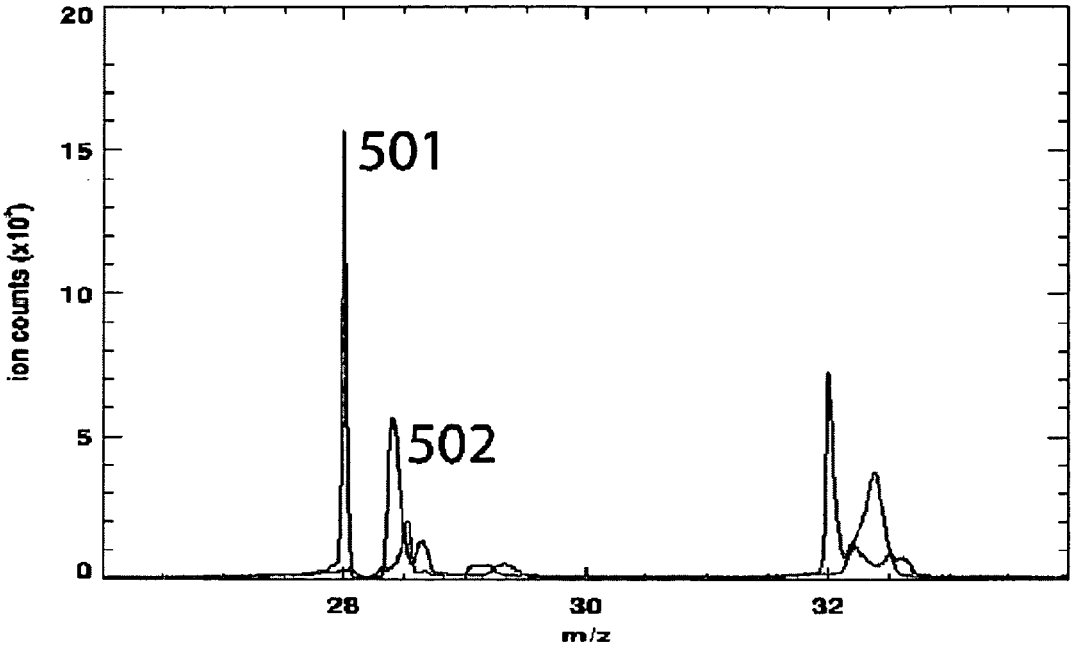
FIG. 17 illustrates a test mass spectrum of room air.

As a test, a single anode detector was used to acquire mass spectral data from a TOF mass-spectral system. For this test, a continuous room-air sample was processed with normal TOF operating parameters running the TOF at 2000 Hz. The TOF anode signal was first preamplified with a gain of 20 and input to the time-to-amplitude converter. The circuit input sensitivity (threshold) was approximately 50 mV after the preamplification stage, or 2.5 mV directly from the anode. The outputs of an embodiment of the circuit described above were connected to an Ionwerks TDCx4 time-to-digital converter. This converter was run in the "list-mode," in which the time-of-arrival of individual events is recorded. Operation in this mode was necessary in order for the display and analysis software to compute event-by-event amplitude estimates. A Time-of-Flight spectrum was obtained from 54338 extractions, which is shown as the line 501 ("Rundown Begin") in FIG. 17. This spectrum of the hybrid circuit reference time shows peaks as expected at mass 28 (Nitrogen) and 32 (Oxygen) with an amplitude ratio of approximately 2:1. The expected abundance ratio is 3.95=79%/20%. This indicates that there are multiple ions arriving simultaneously in the Nitrogen peak. The line 502 ("Rundown End") is a histogram of the event amplitude time. This time histogram is a representation of the measured amplitude distribution of the anode events. (For line 502, the mass scale is not meaningful.)

Figure 18:
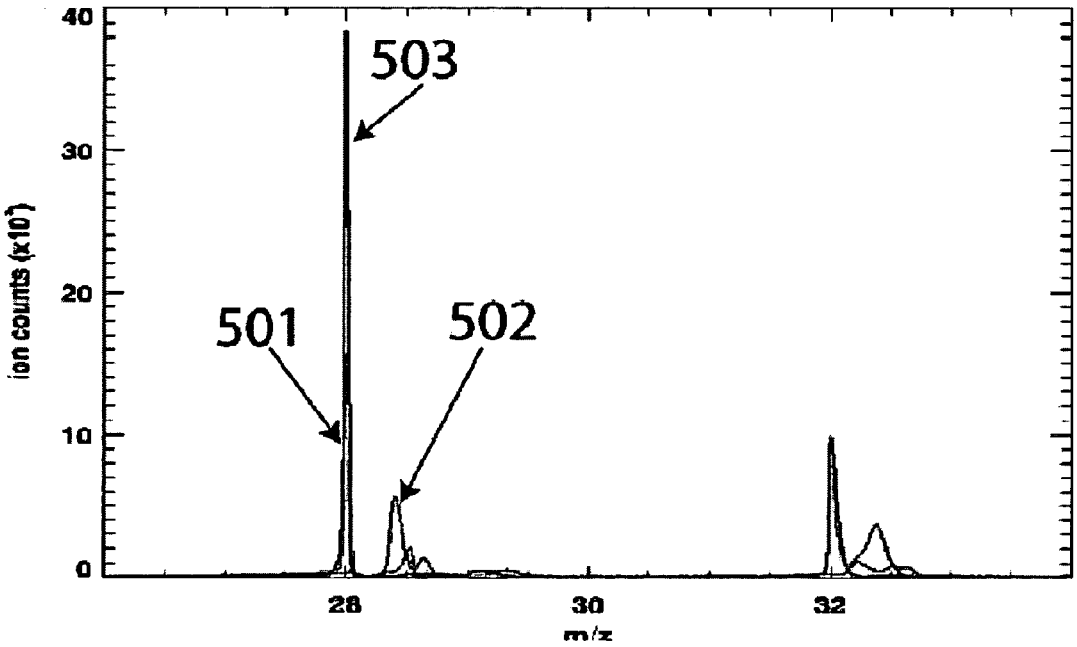
FIG. 18 illustrates a mass spectrum showing abundance recovered from amplitude estimation.

Calibration factors based on oscilloscope recordings of individual anode event pulses and the amplification and time conversion factors of the hybrid measurement circuit were estimated. For the instrumental settings and mass range tested, this value corresponded to about 10 millivolts per single-ion event. The event-by-event time differences were used to estimate the number of simultaneously arriving ions in the mass peaks, based on a table of voltage amplitude at the circuit input versus rundown time. A new mass spectrum was computed from the intensity-weighting data of FIG. 17 and is shown as line 503 ("Calculated") of FIG. 18. The reconstructed amplitude is approx. 4:1—the expected Nitrogen to Oxygen ratio. Thus the hybrid TDC/ADC approach retains the single ion counting timing sensitivity along with the ability to measure the analog response all in the same circuitry.

Additionally, it is possible to use two threshold levels to give added dynamic range to the measurement circuitry. The first threshold is established as low as possible to eliminate microvolt level random noise directly from the detector. An electron pulse height from the detector in response to either one or more ions that are simultaneously hitting the detector will exceed this threshold level and thus will generate a signal indicating the time of arrival of "one or more ions." A second level is then established that is above the maximum detector output amplitude for single ion events. When the amplitude of the detector output has exceeded both of these levels then the circuitry also registers "more than one ion." At this point the time at which the signal amplitude excursion has exceeded the second threshold is recorded and the rundown Analog to Digital detector circuitry is triggered to begin measuring how much the amplitude of this detector output exceeds the second level input. The slope computed from the times between when the detector output amplitude excursion exceeds the first "single ion" threshold and the time of excursion above the second "one or more ion" threshold is computed and stored in correlation with the amplitude by which the second threshold is exceeded. These numbers can be used to improve the peak centroiding computation of the arrival time of each packet of multiple ion time arrivals.

As seen in FIG. 22, this concept can be extended to more than two threshold levels. This concept becomes particularly powerful when the module depicted in FIG. 22 is deployed behind each anode of a multianode array. In this way, individual "ions" can be counted from the region of the electron pulse height distribution, which gives a "discrete" response to multiple simultaneous arrivals and the remaining amplitude of the electron pulse height distribution, which is no longer a discrete distribution, can be measured with the rundown circuit, which is set to begin operation at the highest of all discriminator threshold levels. It is clear that this is not restricted to only three discriminator levels. Alternatively, it is possible to start the analog to time rundown conversion process at the lowest possible threshold level. Each mass peak time amplitude can then be determined after each high voltage extraction pulse 62 (in FIG. 1) and saved in list mode. The assignment of the number of ions can then be derived in the PC after the individually measured pulse heights are histogramed into the complete mass spectrum. In this way the variation of detector output pulse height as a function of mass can be better accounted.

6. A Multiple, Parallel Processing Approach

The circuitry of FIG. 12 can be modified by an analog splitting of the signal between two such circuits. The analog input to the second circuit is blanked until some predetermined time after the single ion threshold has been exceeded at which time the input is allowed to trigger the second measuring circuitry. In a modern high resolution mass spectrometer, the arrival time envelope of ions from a single mass will be around 1 nsec. Thus if the second circuitry is restricted to start amplitude measurements at 1 nsec after the time at which the detector signal first crosses the first threshold level, then the second circuit will be either seeing nothing until a discreet mass peak from a second type of ion arrives or it may be seeing signal resulting from the broadening of the first mass envelope by contributions from a slightly larger mass ion that arrives almost at the same time but at a slightly longer time than the first ion packet.

The blanking described in the previous paragraph is distinguished from the blanking that can be desirably accomplished by disabling half of the anode for half of the time through computer control of the blanking features of the discriminator/rundown circuitry shown in FIG. 12. This is one way of "routing" the signal so that longer time of flight ions from one peak are not obscured by the deadtime of the TDC after having detected a different mass ion arriving slightly earlier. Another way to reduce or eliminate this TDC deadtime between events on one anode is to include a fast router scheme to distribute the anode output between two discriminator/TDC channels.

Figure 14:
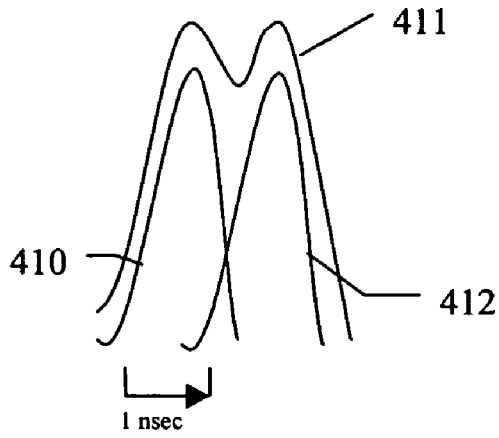
FIG. 14 illustrates a single measurement approach to a multiple mass peak.
Figure 15:
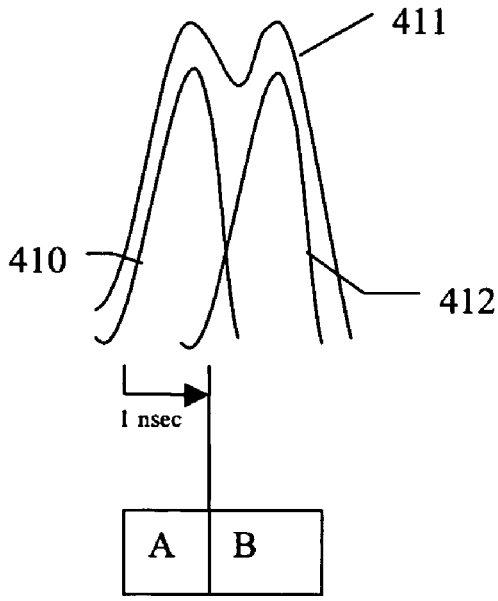
FIG. 15 illustrates a multiple measurement approach to a multiple mass peak.

In the case where there are ions from slightly different flight-times striking the detector in close time proximity (i.e., when the ion peaks overlap), it is possible, as shown in FIG. 14, to modify the circuit to use multiple, parallel processing channels from the same input. The signal from a first mass is shown by 410, the signal from a second mass is shown by 412, and the input signal seen at the processing circuit is shown by 411. In such an implementation at some fixed time after recognition (threshold crossing) of a first peak, further measurement on that channel would be disabled, and, as shown in FIG. 15, simultaneously enabled on a second channel that would continue to process the subsequent portion of the signal in turn. That is, referring to FIG. 15, "A" would be disabled, completing measurement of the first mass, and "B" would be enabled, beginning measurement of the second mass.

In a modern high-resolution mass spectrometer, the arrival time envelope of ions from a single mass peak, and therefore the switching time, will be approximately 1 nsec. This method could be extended as required so that the number of switching steps is at least equal to the maximum length of the first rundown time.

Because the required switching times will be short (i.e., on the order of 1 nsec), implementation of the switching scheme entirely within a custom integrated circuit is desirable to avoid the propagation delays inherent in circuit-board layouts. One embodiment of this approach uses multiple copies of the circuits of 205 through 208 where the enabling signal of the first instance is held "on" until arrival of the signal 411 triggers the first comparator, which can be either 208 or 215. The first circuit instance is then disabled and the second instance enabled to allow measurement of the amplitude of the second signal 412. With knowledge of the amplitude envelope thus measured, computer software can operate to deconvolve the contributions from each of the underlying signals.

7. Time-to-Digital Conversion using Serial Bit Streams

One of the classical designs of a TDC uses a high speed serial-to-parallel shift register to sample the state of an input at precisely timed intervals. Every N intervals, where N is the length (in bits) of the shift register, a parallel output word is presented. By counting the number of parallel words and the bit position(s) within the word where transitions take place, the time-of-arrival of a change-of-state can be computed.

Recent developments in integrated circuits and the need for high-speed communications between integrated circuits, boards, and systems has led to the development of circuits capable of transforming parallel data words to serial bit streams (serializers) and deserializing the bit stream back to parallel data words (deserializers). Many such serializer-deserializer pairs are available and are becoming readily available as part of large-scale programmable logic. They currently can operate at bit-times on the order of 300 psec to 1 nsec. These communications use either special transmission schemes that embed bit-clock timing information into the serial bitstream, or use a separate channel to carry the clock information. The physical medium of transmission can, for example, be modulated electrical voltages or currents transmitted over conductors, modulated light through free space or transparent fibers, or modulated radio-frequency electromagnetic radiation. In any case, a design goal of normal operation of such communication is to carry the original data words without error to the receiver in the presence of disturbances (noise) that may cause unintended changes in the transmitted signals.

If, however, the information (parallel data word) is fixed (or at least known) and used as a "carrier," and the "noise" arises from some signal of interest (e.g., an arrival of ions), then the time-of-arrival of the "noise" event signal can be inferred from the word-position and bit-position where the transmission "error" change occurs.

The means of introducing the event signal onto the carrier would be determined by the medium of transmission, and could, for example, be some digital output of a comparator circuit, modulation of an optical transmission, or some other mechanism sufficient to introduce the appearance of a bit change at the receiver.

The serializer and deserializer could reside entirely within one integrated circuit (FPGA, for example), and the modulation mechanism could be placed external to the device.

As an alternative, only the modulation signal (comparator output signal) could be provided as an input, and the high-speed serial signal could be contained entirely within the integrated circuit.

It is also possible to capacitively couple the serial output stream to the input stream, with the in-vacuum detector anode forming the plates of a coupling capacitor. The charge added to the plates from the electron cloud provoked by ion arrival would be sufficient to cause the desired modulation of the serial bit stream.

Figure 16:
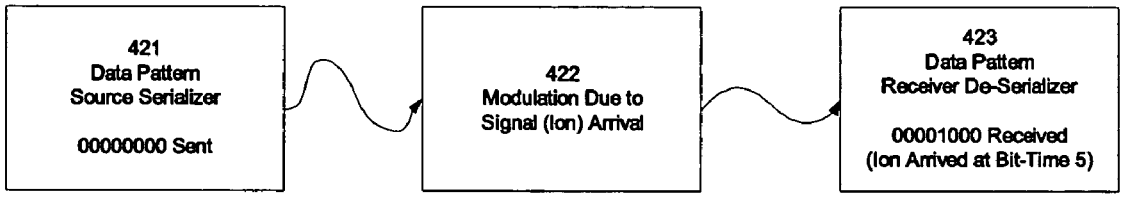
FIG. 16 illustrates a serial bit stream TDC.

As shown by way of example in FIG. 16, "00000000" could be sent by data pattern source serializer 421. Modulation due to signal (ion) arrival could occur at 422, leading to the receipt of "00001000" at data pattern receiver deserializer 423. This bit pattern would indicate that an ion arrived at bit-time 5.

CONCLUSION

One skilled in the art readily appreciates that the present invention is well adapted to carry out the objectives and obtain the ends and advantages mentioned, as well as those inherent therein. Systems, methods, procedures, and techniques described herein are presently representative of the preferred embodiments and are intended to be exemplary and are not intended as limitations of the scope. Changes therein and other uses will occur to those skilled in the art that are encompassed within the spirit of the invention or defined by the scope of the claims.

We claim:

1. A method for determining the number, time of arrival, and impact position of a plurality of ions arriving at a detector surface, comprising:

providing a multi-channel plate that produces an electron cloud in response to receiving an impinging ion;

defocusing said electron cloud onto a pixelated anode array;

measuring the fractions of said electron cloud received by nearest neighbor electrodes in said anode array; and, centroiding the electron charge fraction appearing simultaneously on nearest neighbor anodes in said anode array to determine the number of ions impinging said detector surface, the time of arrival of each said impinging ion, and the spatial location at which each said impinging ion collided with said detector surface.

2. The method of claim 1 wherein said pixelated array is an array of 64 anodes.

3. The method of claim 1 wherein said pixelated array is an array of 256 anodes.

4. The method of claim 1 further comprising the step of providing a meander delay line in front of said pixelated array.

5. A method for detecting the time of arrival of an ion signal in a time-of-flight mass spectrometer, comprising:

serializing a known parallel data word into a serial data stream;

modulating said serial data stream with said ion signal, thereby creating a modulated serial data stream; and, deserializing said modulated serial data stream to determine said time of arrival.

* * * * *